US009463857B1

(12) United States Patent
Schiller et al.

(10) Patent No.: US 9,463,857 B1
(45) Date of Patent: Oct. 11, 2016

(54) WATERCRAFT

(71) Applicant: Schiller Sports, Inc., San Francisco, CA (US)

(72) Inventors: Judah Schiller, San Francisco, CA (US); Marcus Hays, San Francisco, CA (US)

(73) Assignee: Schiller Sports, Inc., San Francisco, CA (US)

( * ) Notice: Subject to any disclaimer, the term of this patent is extended or adjusted under 35 U.S.C. 154(b) by 0 days.

(21) Appl. No.: 14/704,137

(22) Filed: May 5, 2015

Related U.S. Application Data

(60) Provisional application No. 61/996,374, filed on May 5, 2014.

(51) Int. Cl.

| | |
|---|---|
| ***B63H 16/20*** | (2006.01) |
| ***B63H 16/08*** | (2006.01) |
| ***B63H 5/125*** | (2006.01) |
| ***B63H 23/02*** | (2006.01) |
| ***B63B 3/06*** | (2006.01) |
| ***B63B 1/12*** | (2006.01) |

(52) U.S. Cl.
CPC ..... *B63H 16/14* (2013.01); *B63B 1/12* (2013.01); *B63B 3/06* (2013.01); *B63H 5/1252* (2013.01); *B63H 16/20* (2013.01); *B63H 23/02* (2013.01); *B63H 2023/0216* (2013.01)

(58) Field of Classification Search
CPC ..... B63B 43/00; B63B 43/14; B63H 16/14; B63H 16/20
USPC ..... 440/12, 21, 26, 27, 28, 29, 30, 31
See application file for complete search history.

(56) References Cited

U.S. PATENT DOCUMENTS

| | | | | |
|---|---|---|---|---|
| 1,761,884 | A * | 6/1930 | Gorski | B63H 16/14 440/30 |
| 5,374,206 | A * | 12/1994 | Gregory | B63H 16/14 440/27 |
| 5,718,611 | A * | 2/1998 | Schlangen | B63H 16/14 440/27 |
| 6,165,030 | A | 12/2000 | Lewis et al. | |
| 6,309,263 | B1 * | 10/2001 | Mier-Maza | B63B 43/14 440/21 |
| 9,254,895 | B2 | 2/2016 | Choi | |

FOREIGN PATENT DOCUMENTS

| | | | |
|---|---|---|---|
| KR | 1020030090952 | A | 12/2003 |
| WO | 2009035252 | A2 | 3/2009 |
| WO | 2010091485 | A2 | 8/2010 |
| WO | 2014054866 | A1 | 4/2014 |

OTHER PUBLICATIONS

Korean Intellectual Property Office, International Search Report and Written Opinion for PCT/US2015/000472, May 19, 2016, 15 pgs.

* cited by examiner

*Primary Examiner* — Lars A Olson
(74) *Attorney, Agent, or Firm* — Kenneth H. Ohriner; Perkins Coie LLP

(57) ABSTRACT

A human powered watercraft has a bicycle type pedal and crank drive system linked to a propeller on a vane which positions the propeller below the water line, when in use. The propeller is driven via the crank drive system which may include gears, pulleys or sprockets linked to the propeller via belts or chains, and one or more reduction systems. A handle bar supported on the hull has a steering system connected for steering the vane, or the propeller on the vane, via cables.

10 Claims, 32 Drawing Sheets

WATERCRAFT

PRIORITY CLAIM

This application claims priority to U.S. Provisional Patent Application No. 61/996,374 filed May 5, 2014, and incorporated herein by reference.

BACKGROUND OF THE INVENTION

Human powered watercraft tend to have low drive train efficiency. Current designs generally have comparatively high friction. The commonly used rudder used in combination with a propeller contributes to viscous drag. Propulsion systems not using propellers generally compromise steering and induce a wide turning radius, which may be a factor in safe navigation. Many currently used propulsion and steering controls project far below the waterline, which can hamper, or even prevent propulsion in shallow water. Accordingly, engineering challenges remain in designing human powered watercraft that are highly efficient as well as highly maneuverable.

SUMMARY OF THE INVENTION

A self-propelled watercraft has a propulsion system using pedals and/or hand cranks that drive a propeller using rotationally orientated cranks, pulleys, shafts and gears. An output shaft may be connected to a shaft that is operably coupled to at least one propeller. No rudder is needed as steering the propeller may provide directional control via a pair of vertical control arms mounted on either side of the propeller.

DETAILED DESCRIPTION

Figure 1A:
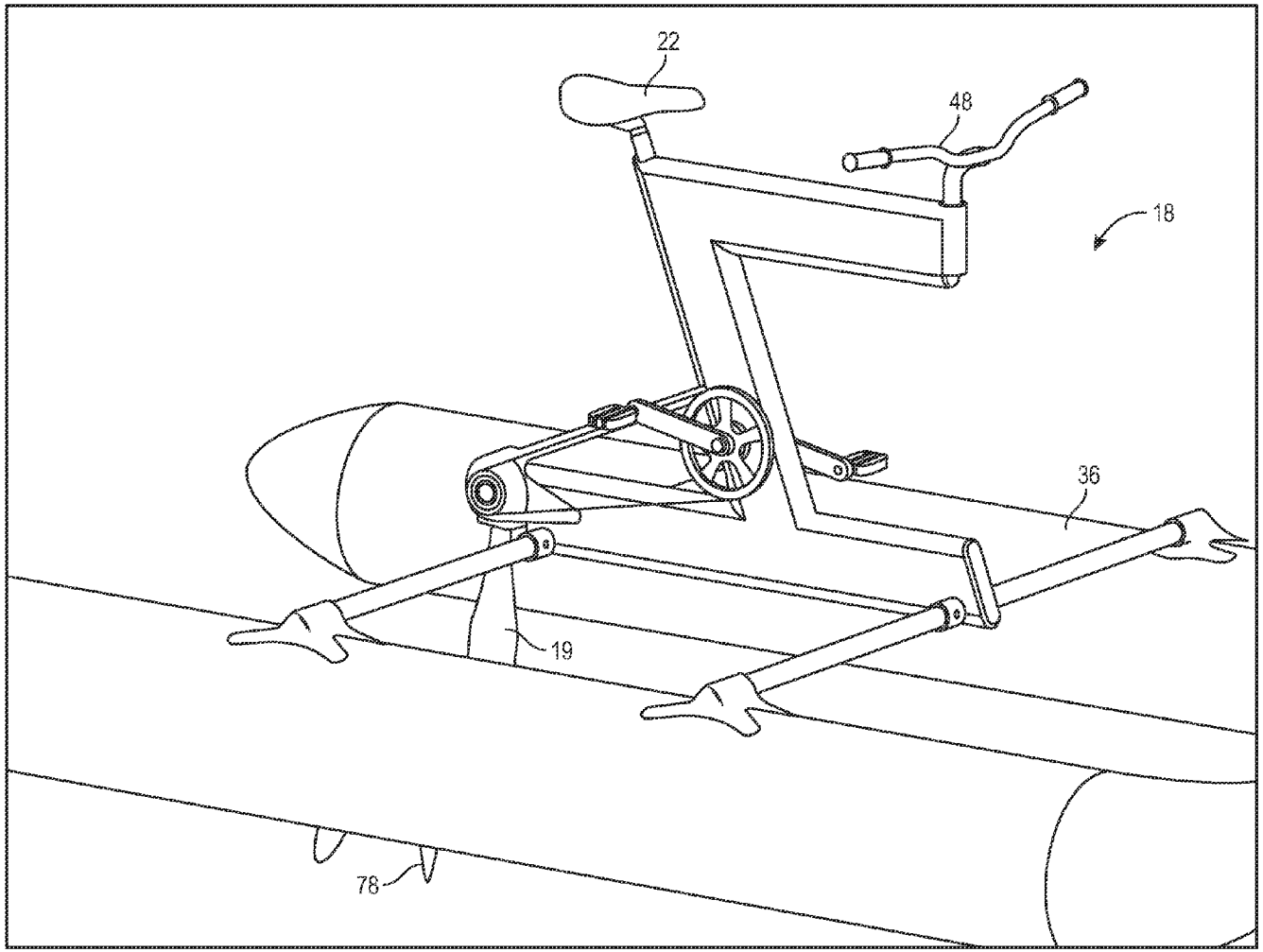
FIG. 1A is a front, top and right side perspective view of a new waterbike.
Figure 1B:
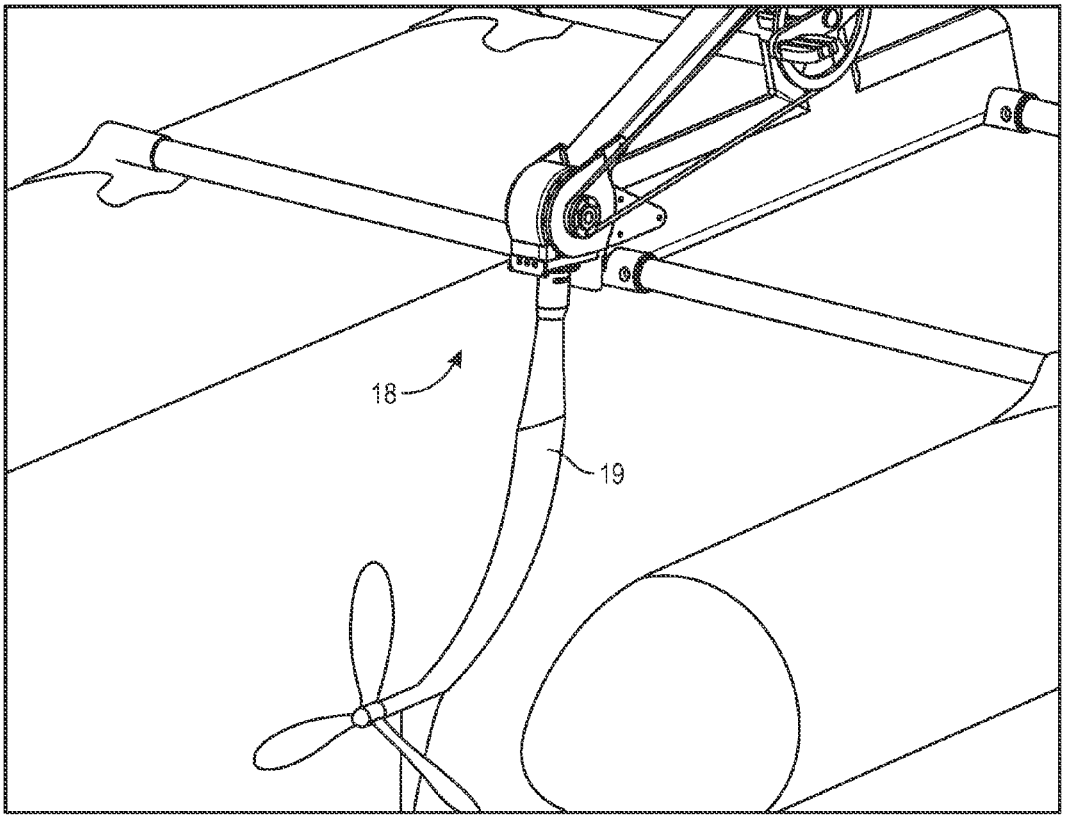
FIG. 1B is an enlarged rear, top and right side perspective view of the waterbike shown in FIG. 1A.
Figure 1C:
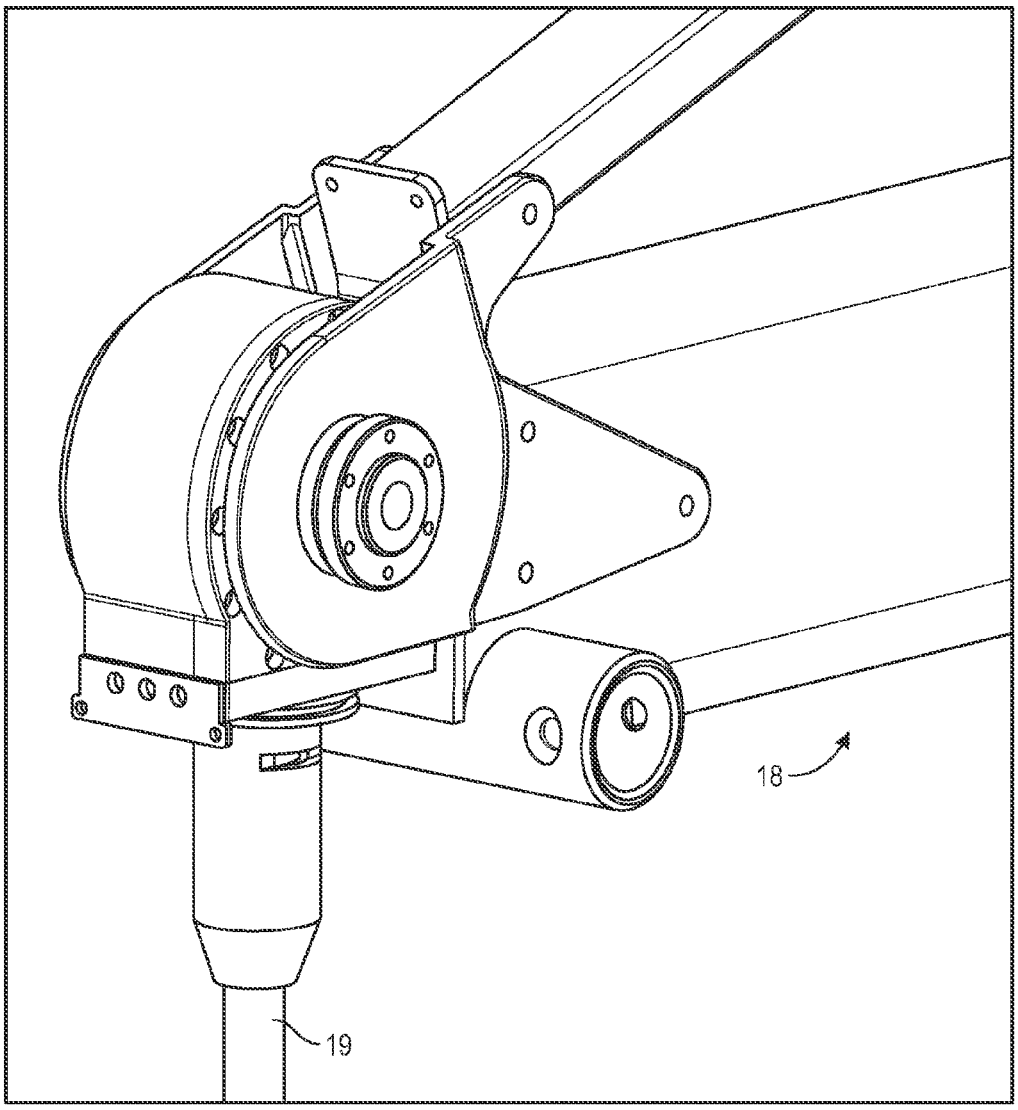
FIG. 1C is a further enlarged view of the waterbike shown in FIG. 1B.

As shown in FIGS. 1A-1C a waterbike 18 may have a drive system and a steering system linked to a single propeller supported on a vane 19. The waterbike 18 may share one or more of the design elements shown in FIGS. 2-30.

Figure 2:
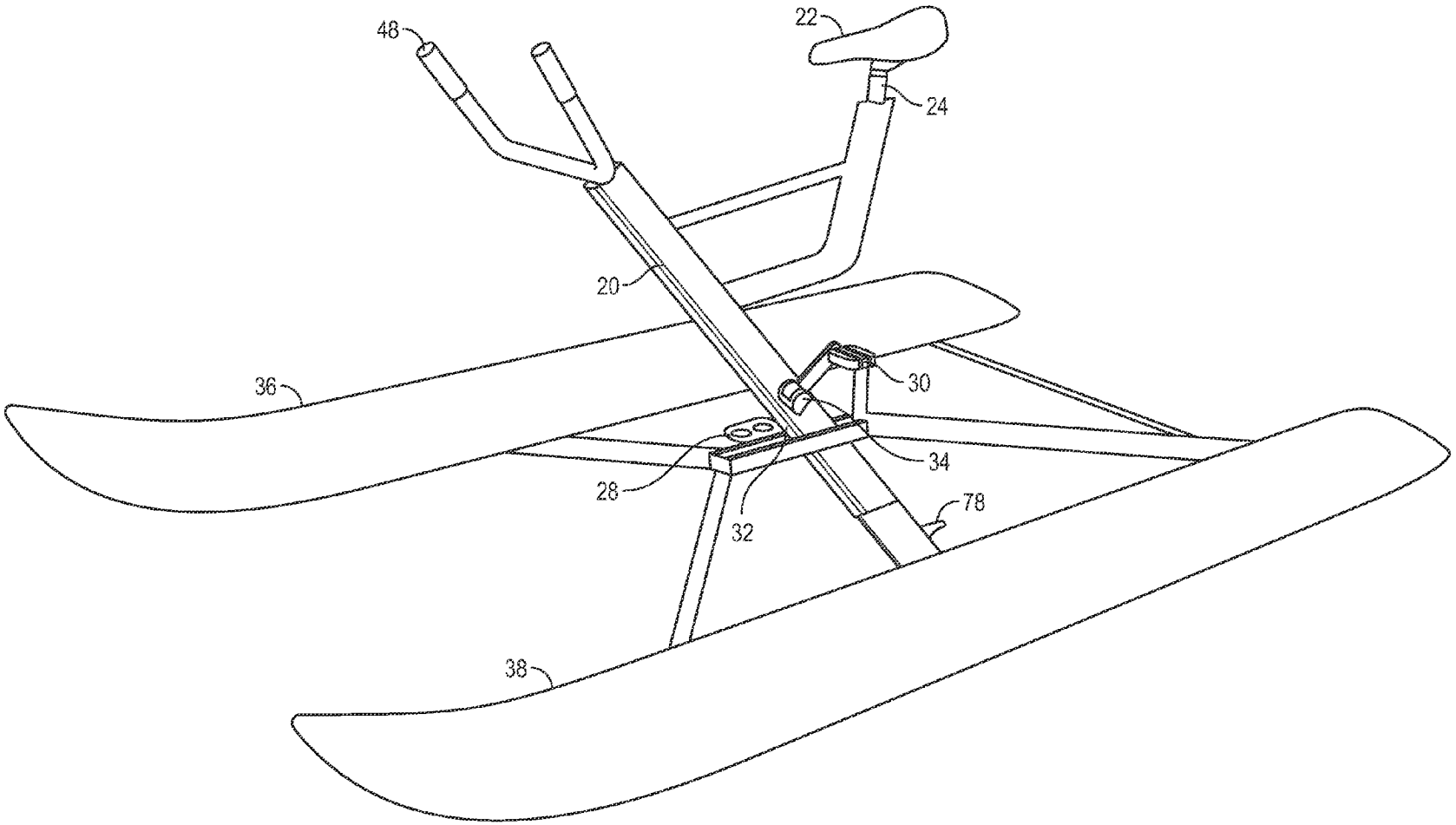
FIG. 2 is a perspective view of a second waterbike design.
Figure 3:
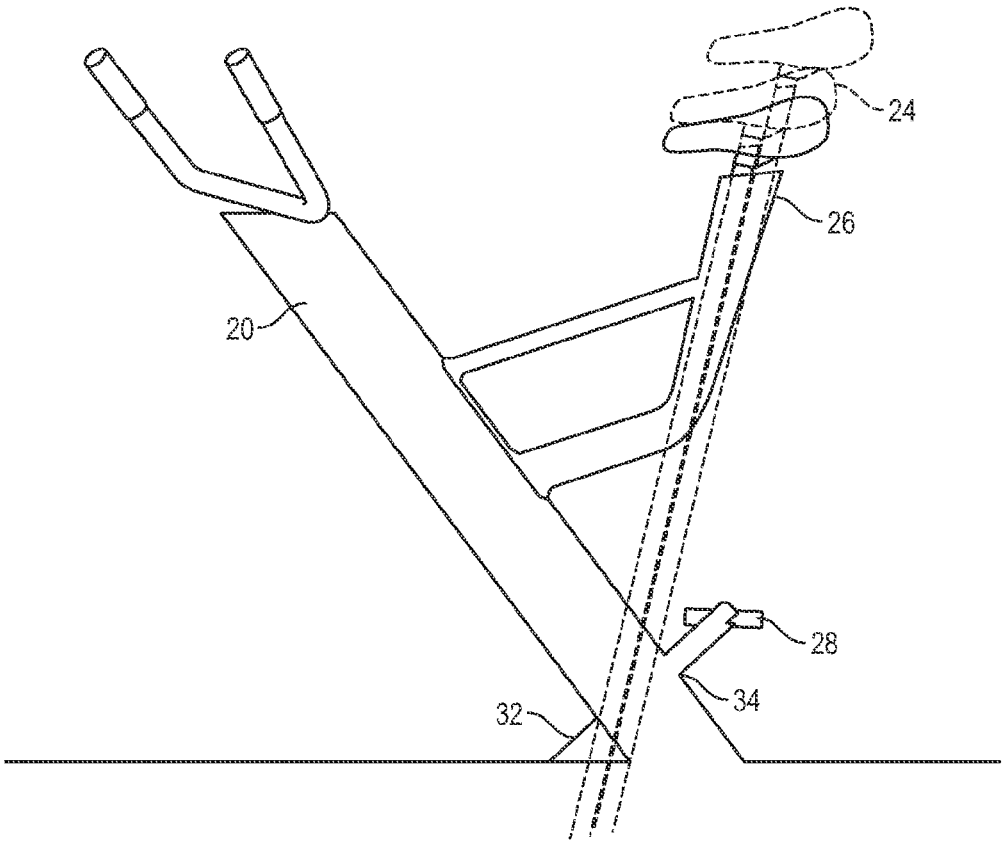
FIG. 3 is a partial section of the waterbike of FIG. 2.
Figure 4:
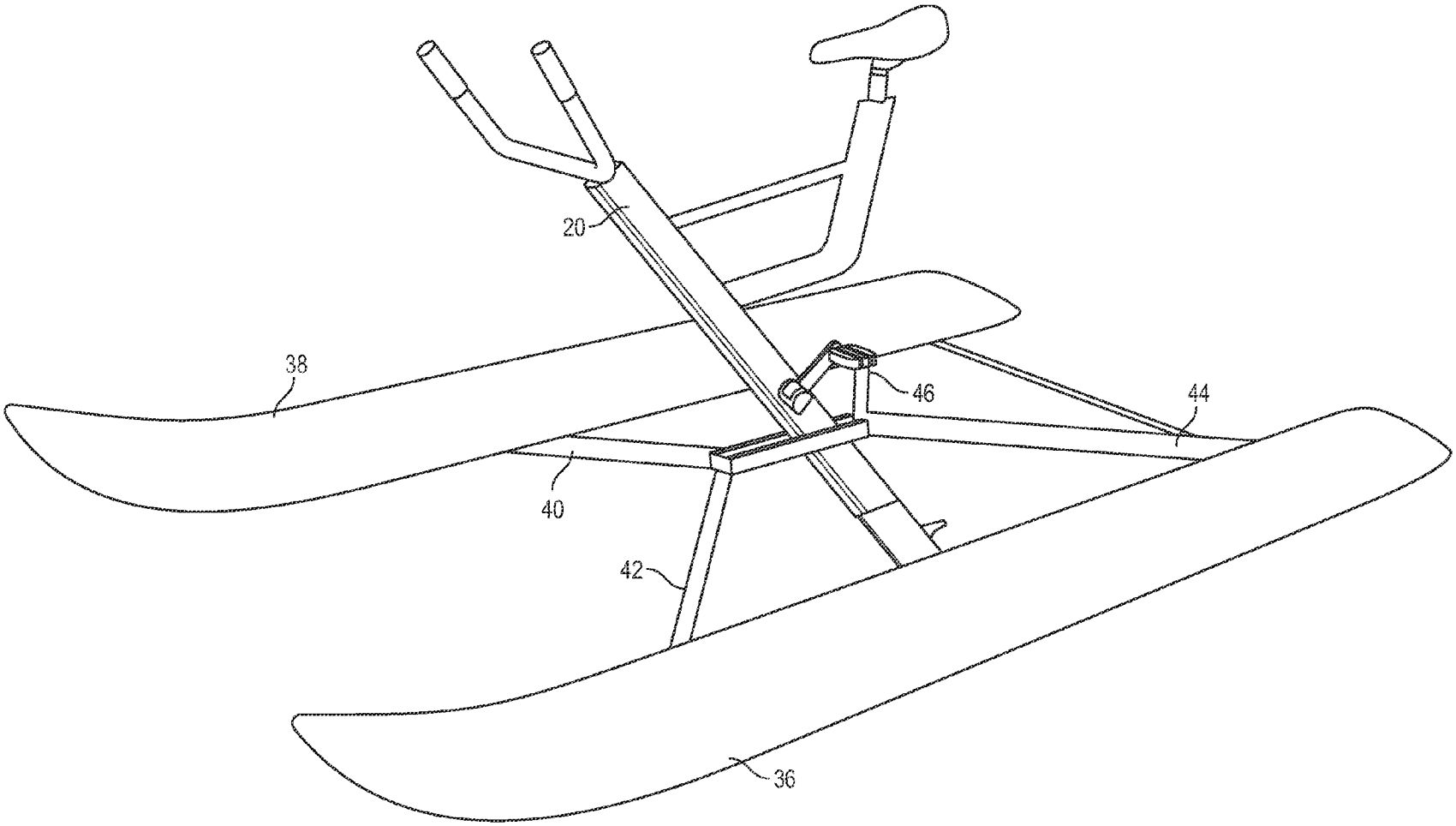
FIG. 4 is a view of the waterbike of FIG. 2 with additional element numbers shown.
Figure 5:
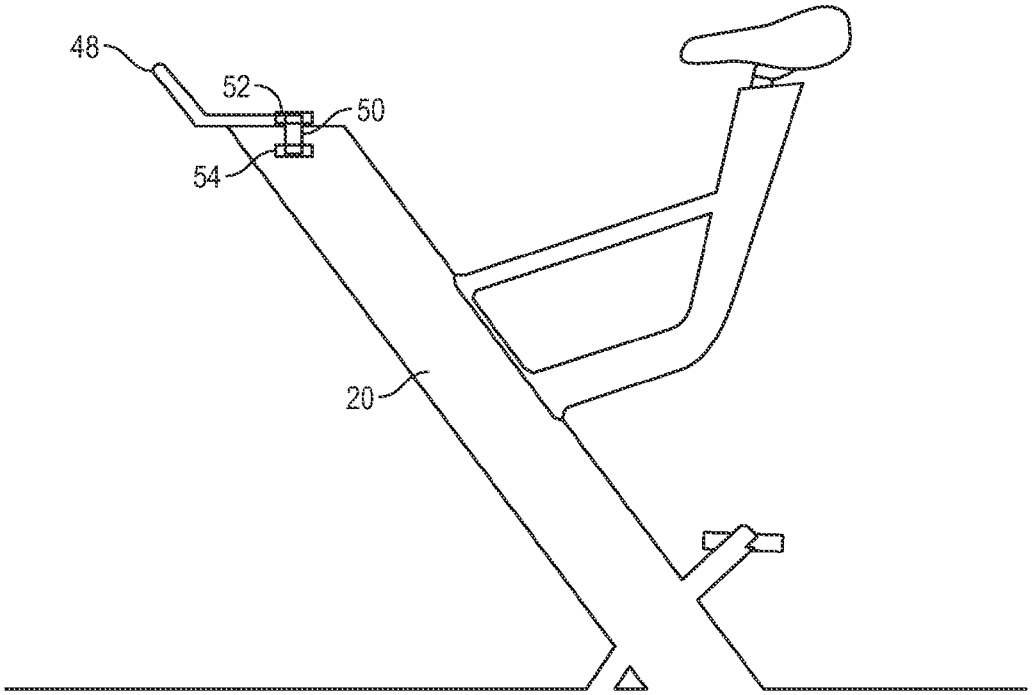
FIG. 5 is a partial section view of an alternate design.

In FIG. 2 a waterbike 20 has a frame 20 made for example, from composite materials such as carbon fiber, or aluminum formed by stampings or molds. In the example shown, the frame 2 is attached to four diagonally opposed connecting struts 40, 42, 44 and 46, such that the frame 20, is coupled to a pair of inflatable pontoons 36 and 38. A seat 22 is attached to a seat-post 24, that is coupled to a frame 20. Pedals 28 and 30 are attached to a pair of crank arms 32 and 34, that are adapted to be rotated by the user's feet. The crank arms drive a propeller 78 through a drive system. The seat post 24 may be provided with staggered mounting holes 26, such that the seat post can be staggered to effect an ideal angle in relationship to the rider's hips. A set of handlebars 48 are attached to a shaft 50 captured by an upper bearing 52 and a lower bearing 54, such that the handlebars rotate about the frame 20, as shown in FIG. 5.

Figure 6:
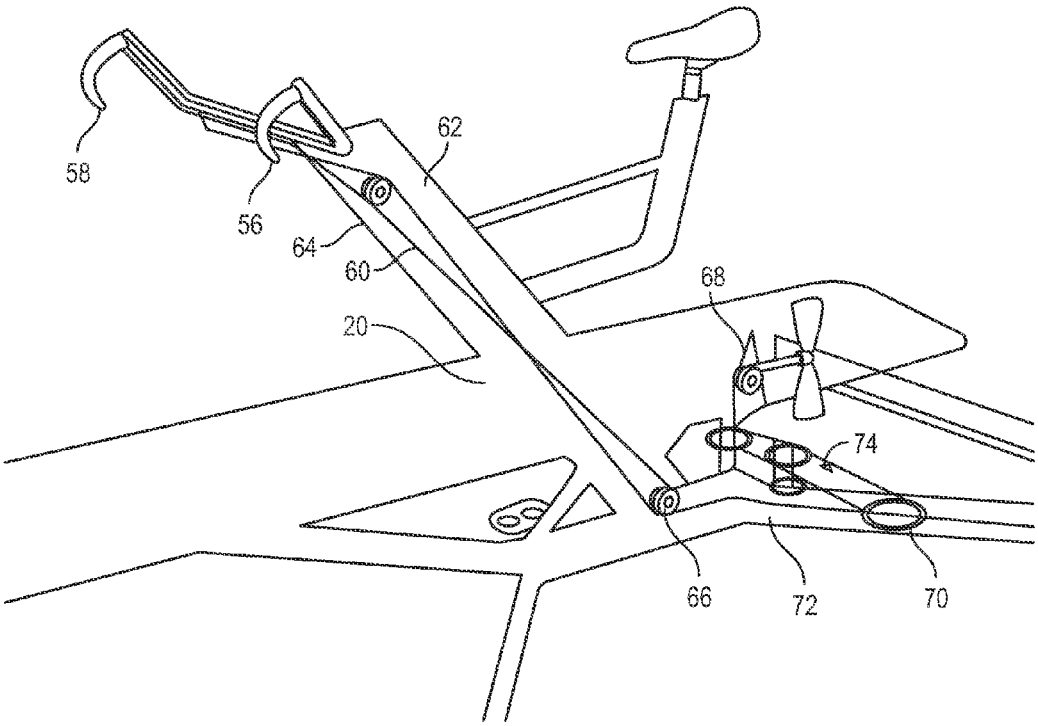
FIG. 6 is an internal view showing components of the waterbike of FIG. 2.

The handlebars 48 may optionally be rigidly attached to the frame 20, such that the handlebars do not rotate. In this case, a right-hand lever 56 and a left-hand lever 58 are attached to a right-hand cable 60, and a left-hand cable 62, respectively. Each steering cable 60 and 62 passes under a series of tensioning pulleys 64, 66, 68 and 70, with the cables extending out of the frame and attaching to a bell-crank 72. When one of the two steering control levers is squeezed, the bell-crank 72 pivots about a mounting shaft 74, such that the squeezed lever contracts one of the steering cables, while the opposite steering cable extends, as shown in FIG. 6.

Figure 7A:
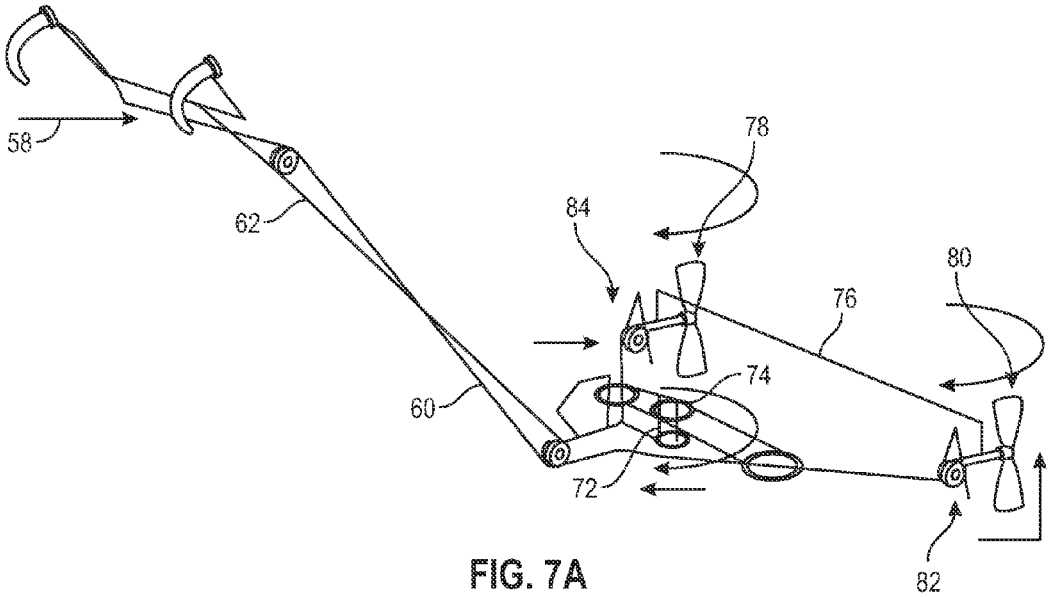
FIGS. 7A and 7B are schematic diagrams of steering components of the waterbike of FIG. 2.
Figure 7B:
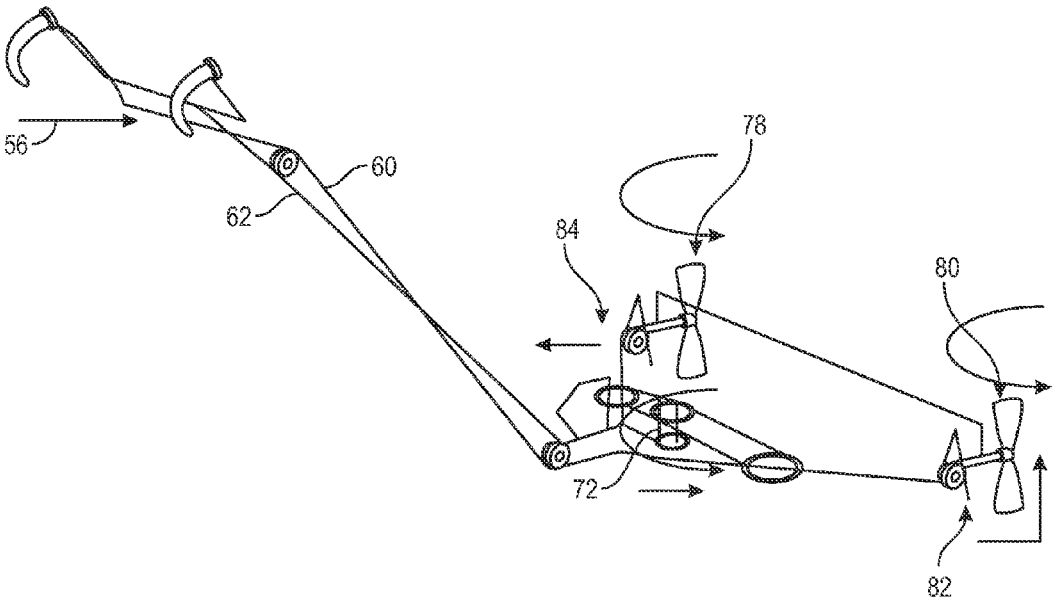

A third cable 76 connects the bell crank to one propeller 78, or two propellers 78 and 80. Squeezing either control lever 56 or 58 causing the bell-crank 72 to pivot against the mounting shaft pivot point 74, and the third cable 76 steers or aims the propellers, providing directional control, as shown in FIG. 7.

Figure 8:
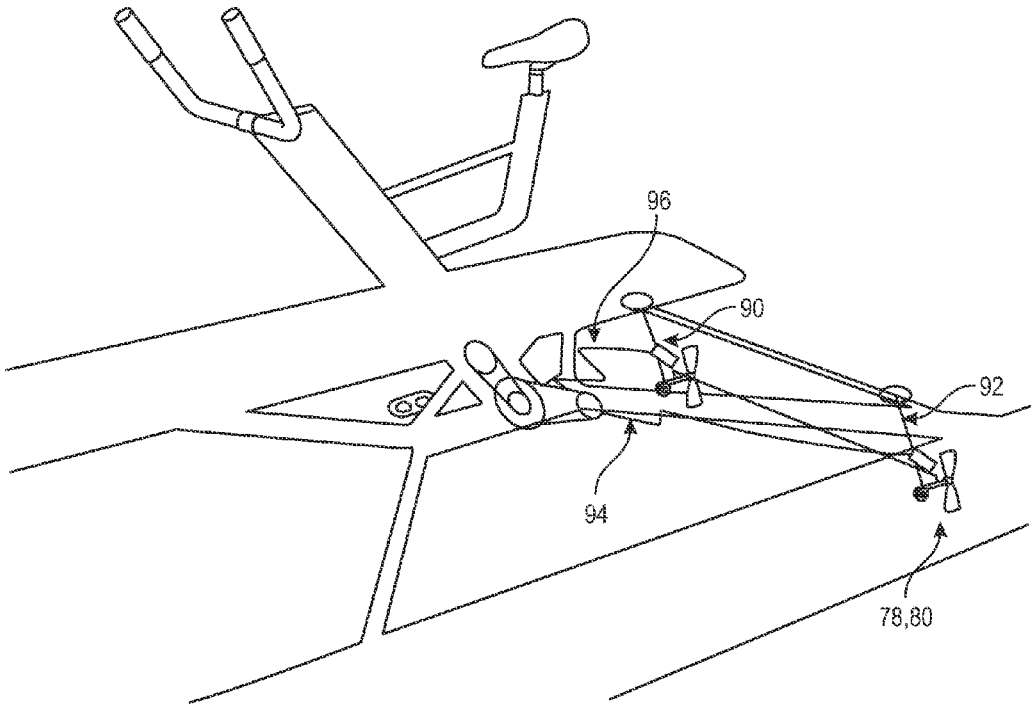
FIG. 8 is a schematic diagram of an alternative drive system.

To minimize viscous drag, a propeller 78, or propellers 78 and 80, are operably coupled to one or two reaction arms 90 and 92, which are operably coupled to one two spiral shafts 94 and 96, and which provide steering control in place of a viscous drag inducing rudder, FIG. 8.

Figure 9:
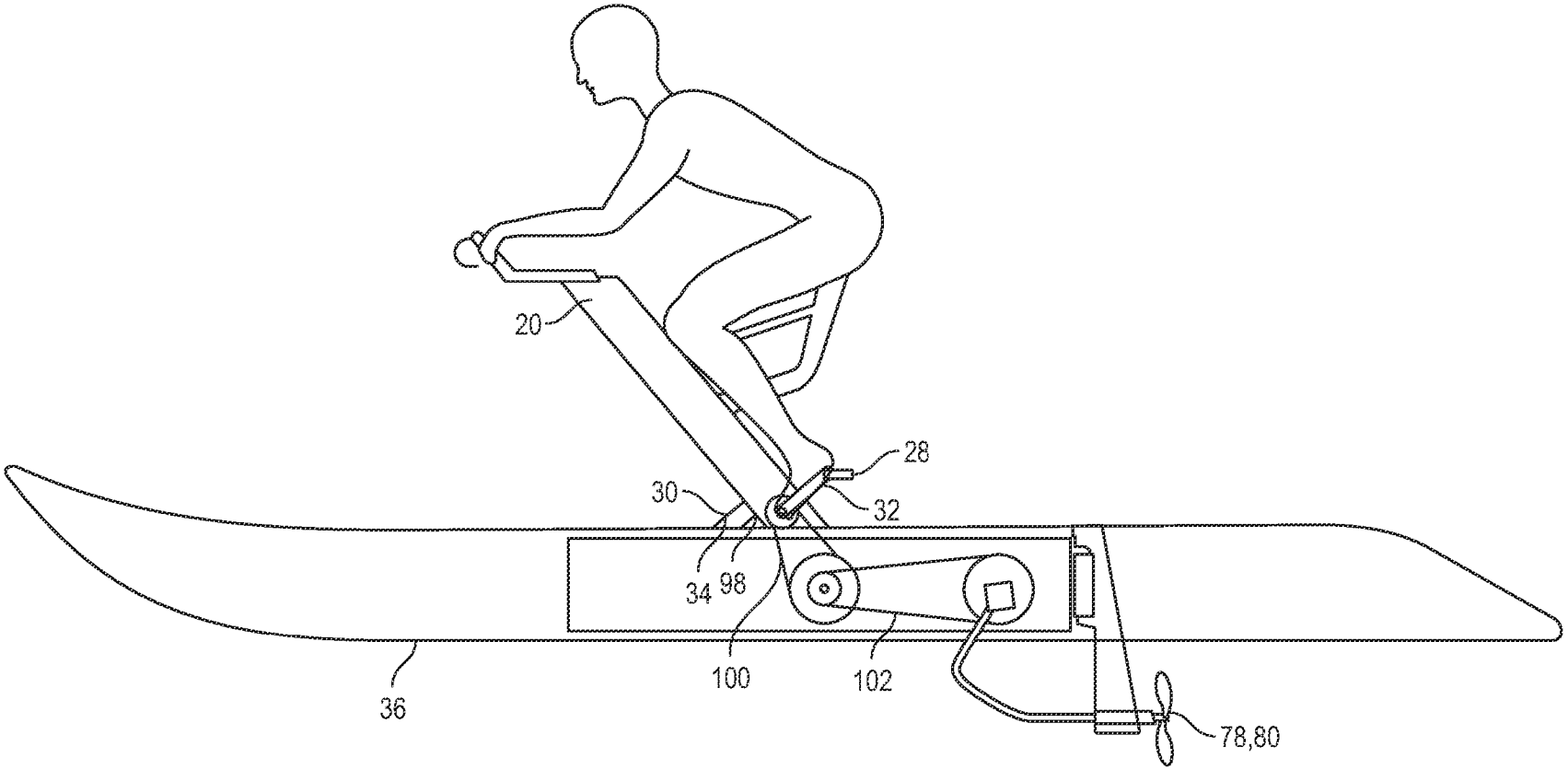
FIG. 9 is a side view of another drive system that may be used in the waterbike of FIG. 1A or 2.

The pedals 28 and 30 are coupled to crank arms 32 and 34, which are coupled to an input shaft 98, that upon rotation, rotates a gear-train comprised of a least two stages of reduction, which in each stage is comprised by a pair of pulleys and a belt, or plastic chain, described as a primary reduction stage 100, and a secondary reduction stage 102, FIG. 9.

Figure 10:
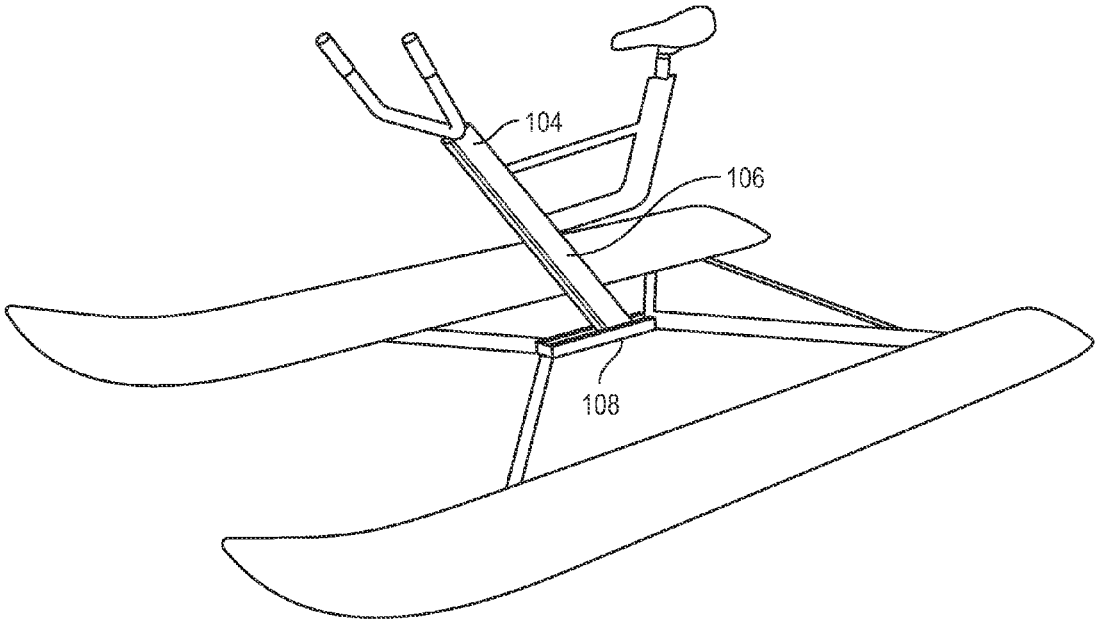
FIG. 10 is a side view of an alternative design.
Figure 11:
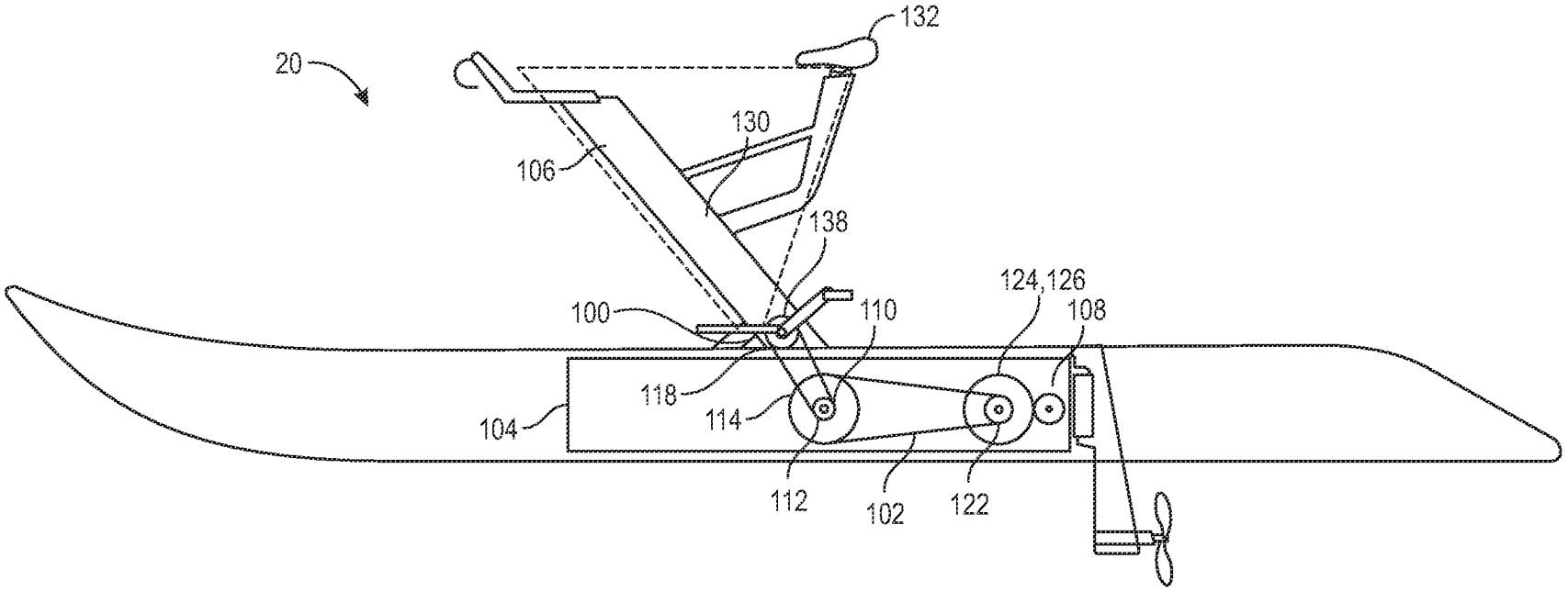
FIG. 11 is a diagram of elements and positions useable in the waterbike of FIG. 2.

To protect and isolate the gear-train workings from the corrosive effects of water, the gear train is housed within the interior of a watertight frame compartment 104 that is comprised of frame members that intersect at varying angles 106, and 108, FIG. 10.

At the intersection between these intersecting watertight frame members 106, and 108, is located a jackshaft 110. Coupled to the jackshaft 110, are two pulleys or sprockets; a small diameter 112 and a large 114. By virtue of centering the jackshaft 110, at the intersection 116 between the watertight frame members 106 and 108, a dimensional circumference 118, is provided that accommodates a pulley or sprocket 114, that is at least 3-times larger in diameter than the pulley or sprocket 138, that is coupled to the input shaft, a tertiary shaft 122, or a bicycle transmission 124, or a motor 126, FIG. 11.

Figure 12:
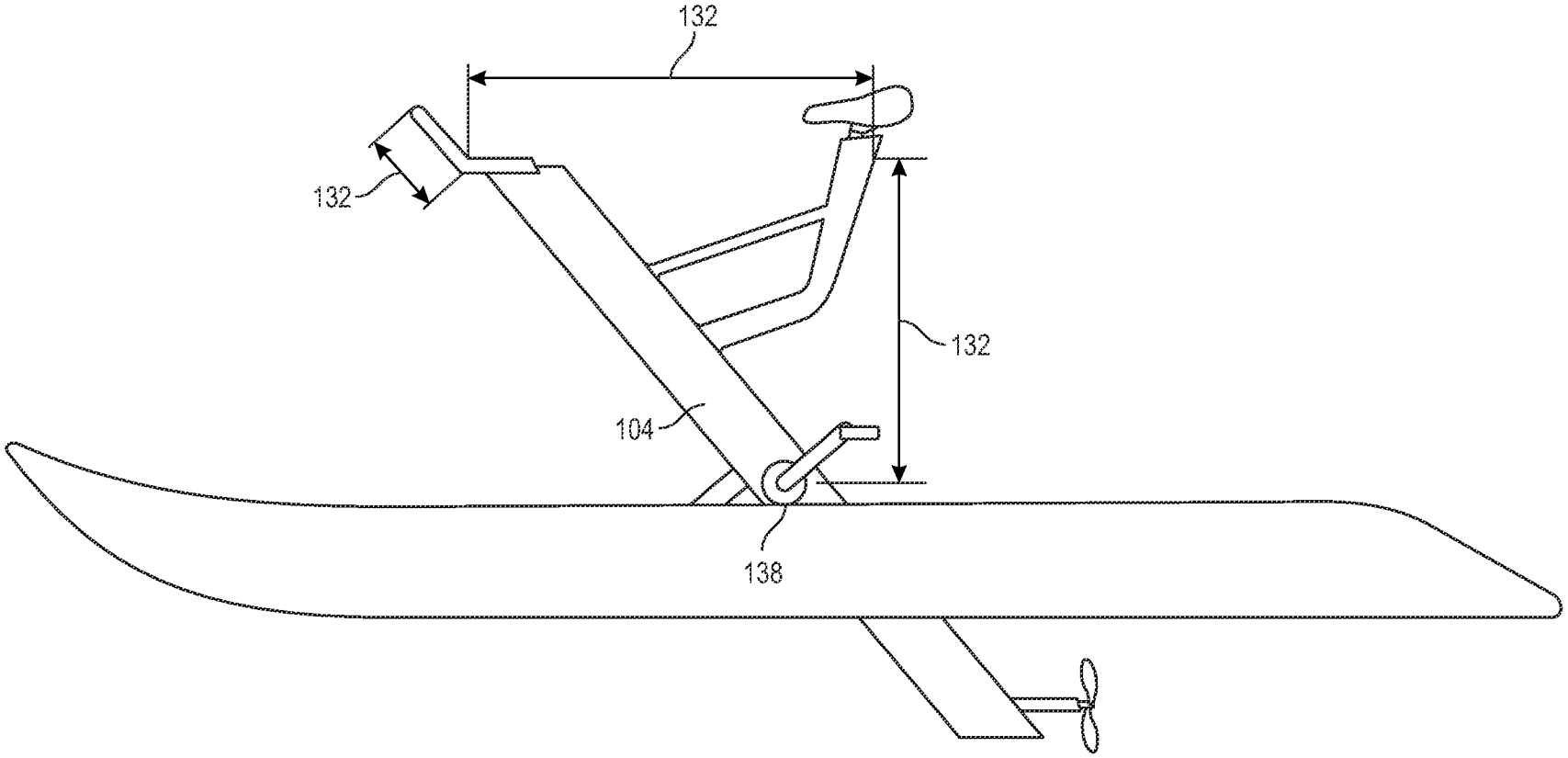
FIG. 12 is a side view of examples of dimensions used in the waterbike of FIG. 1A or 2.
Figure 13:
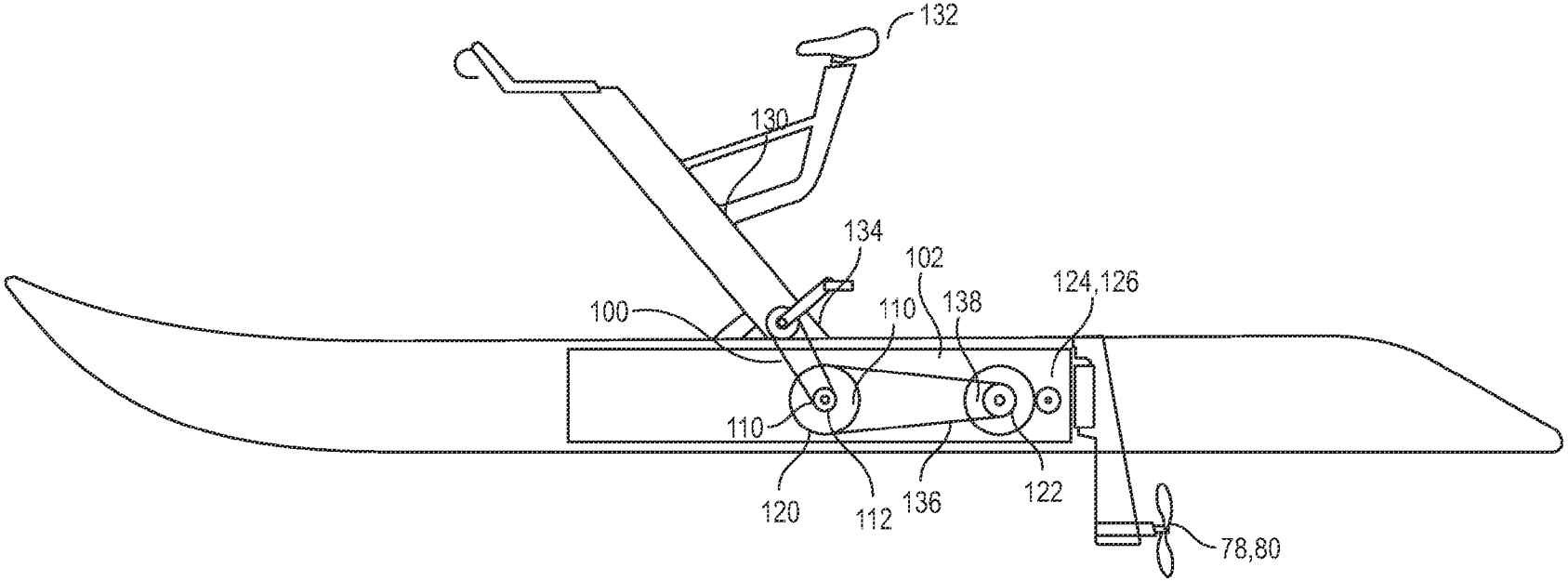
FIGS. 13-16 are side views of additional waterbike examples.

The diameter of a first pulley or sprocket 138 being housed within a watertight compartment 104, is necessarily constrained in its diameter by the constrains of the surrounding watertight compartment 104, that due to a proportionality constrained by human factors 132, including leg, arm and torso lengths, constrains the mechanical gear train components within the watertight compartments 104 and 106 of the watercraft 20, FIG. 12.

A first belt or plastic chain 134, couples a first pulley or sprocket 138, that is coupled to the input shaft 98, that is coupled to a small diameter jackshaft pulley or sprocket 112, which is coupled to a jackshaft 110, and which so arranged comprises the primary stage of reduction 100. The primary reduction stage 100 provides a minimum 3:1 ratio of gear reduction between the input shaft 98 and the jackshaft 110. A belt or plastic chain 136, couples the third pulley or sprocket 120, that is coupled to the jackshaft 110, to a fourth pulley or sprocket 138, that is smaller in diameter as compared to the third pulley or sprocket 120, such that a secondary stage of gear reduction is provided 102, that provides a minimum of 3:1 in gear reduction, and which in addition to the first stage if reduction 100, provides a 6:1 ratio between the input shaft 98 and the propeller 78, or propellers 78 and 80. The second belt or plastic chain 136, that couples the third pulley or sprocket 120, to the jackshaft 110, and the tertiary shaft 122, or, optionally, the bicycle transmission 124, or optionally still, the motor 126, and finally to the fourth pulley or sprocket 138, comprises the second stage of gear reduction 102, and shown in FIG. 13.

Figure 14:
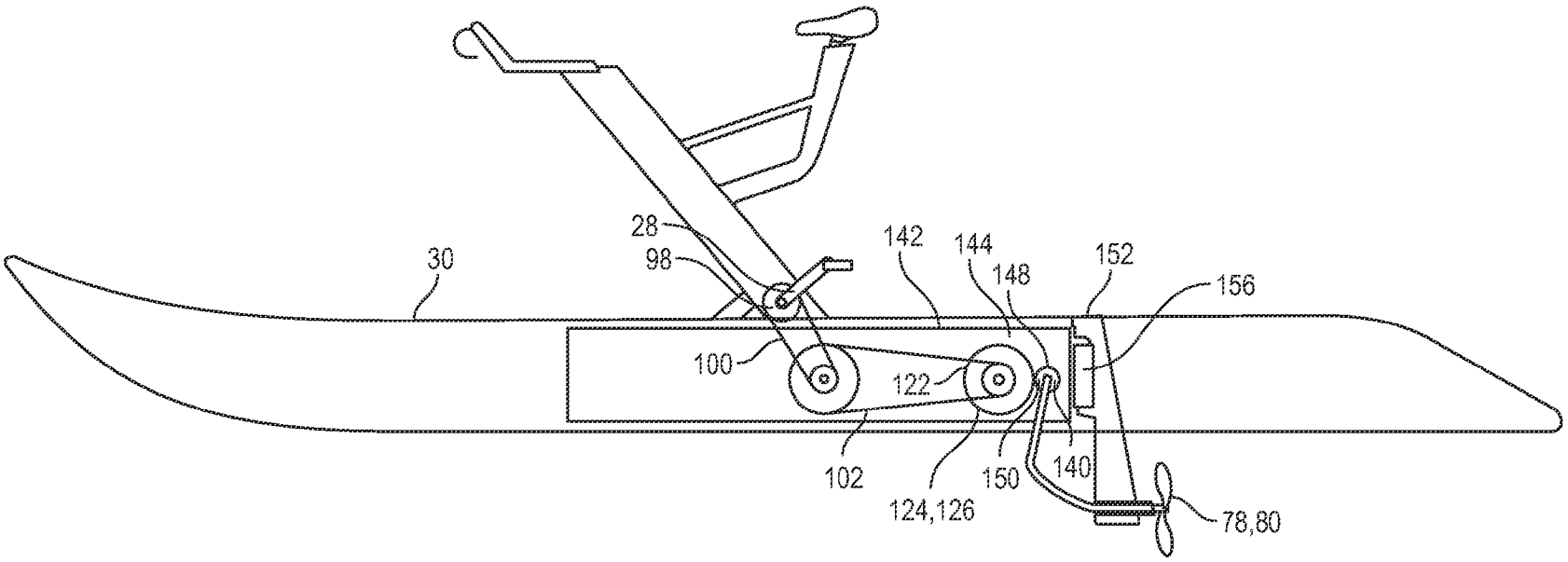

At either or both outboard ends of the output shaft 140, is a male or female coupling 148 and 150, where a spiral shaft 94, or optionally, two spiral shafts 94 and 96, are operably coupled to the male of female couplings 148 and 150, such that the spiral shafts are coupled to the output shaft 140, that is coupled to the second spur gear 144, preceded by the first spur gear 142, that is coupled to the tertiary shaft 122, or optionally a bicycle transmission 124, or optionally a motor 126, that is coupled to the second stage of reduction 102, that is coupled to the primary stage of reduction 100, and ultimately to the pedals 28 and 30, whereby when the pedals are rotated, the spiral shaft 94, or shafts 94 and 96, the propeller 78, or propellers 78 and 80, rotate at 9 revolutions for every one revolution of the input shaft 98, as shown in FIG. 14.

Figure 15A:
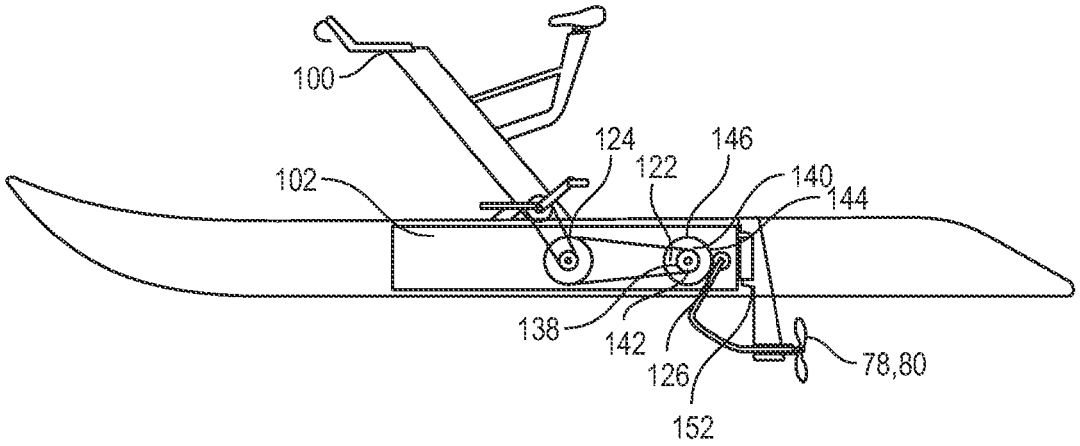
Figure 15B:
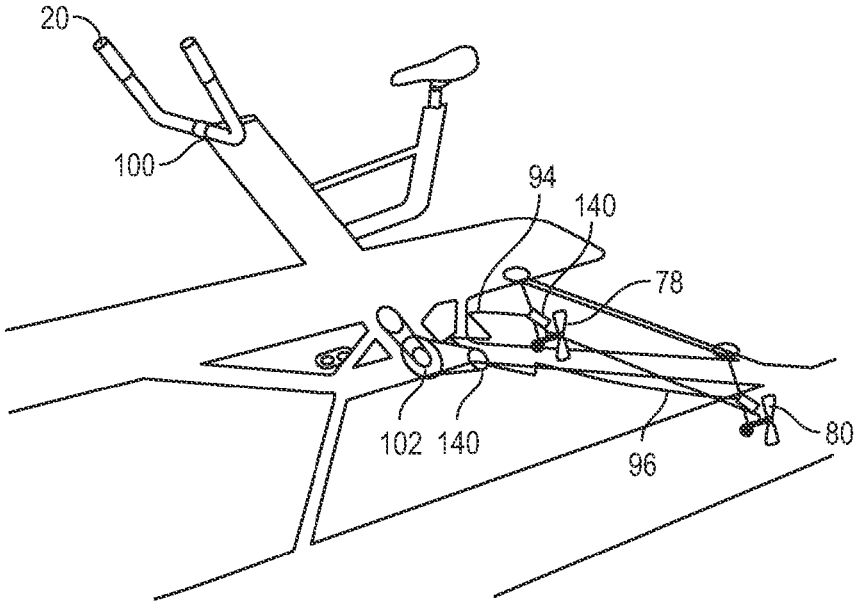

A frame 20, with pontoons 36 and 38, incorporates a third stage of reduction 146, and is additionally comprised of a fourth pulley or sprocket 138, that couples the tertiary shaft 122, or optionally, a bicycle transmission 124, or as yet another option, a motor 126, to an output shaft 140, which when the tertiary shaft 122 is replaced by the bicycle transmission 124, or the electric motor 126, has a first spur gear 142, coupled to a second spur gear 144, which is coupled to an output shaft 140, to which is coupled a male for female fitting 150, to which is coupled to at least one spiral shaft 94, or optionally, two spiral shafts 94 and 96, which is, or are coupled to a propeller 78, or propellers 78 and 80. The third reduction stage 146, provides a 3:1 minimum ratio of gear reduction, which when incorporated with the primary reduction stage 100 and the secondary reduction stage 102, provide in total a 9:1 fixed ratio when unaided by the optional bicycle transmission 124, or optional motor 126, as shown in FIG. 15.

Figure 16:
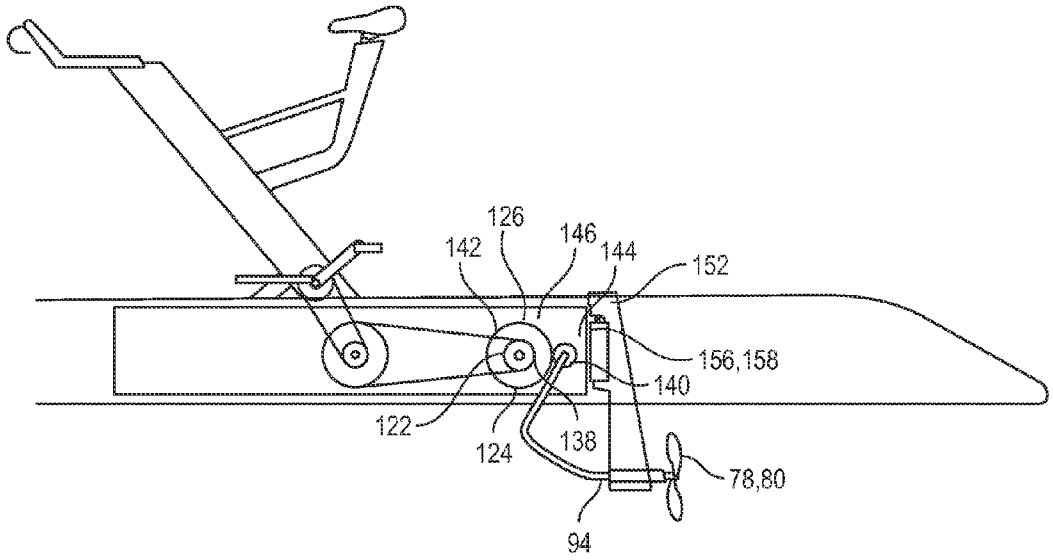

In an alternative with a single propeller 78, a rudder is substituted for a reaction arm 152, which is adapted to be coupled to a spiral shaft 94, and substitutes rudder pintles for a reaction arm control rod 158, and which is coupled to the watercraft by a insertion of the rudder into the pintles, that couples the rudder to the frame 20, as shown in FIG. 16.

Figure 17A:
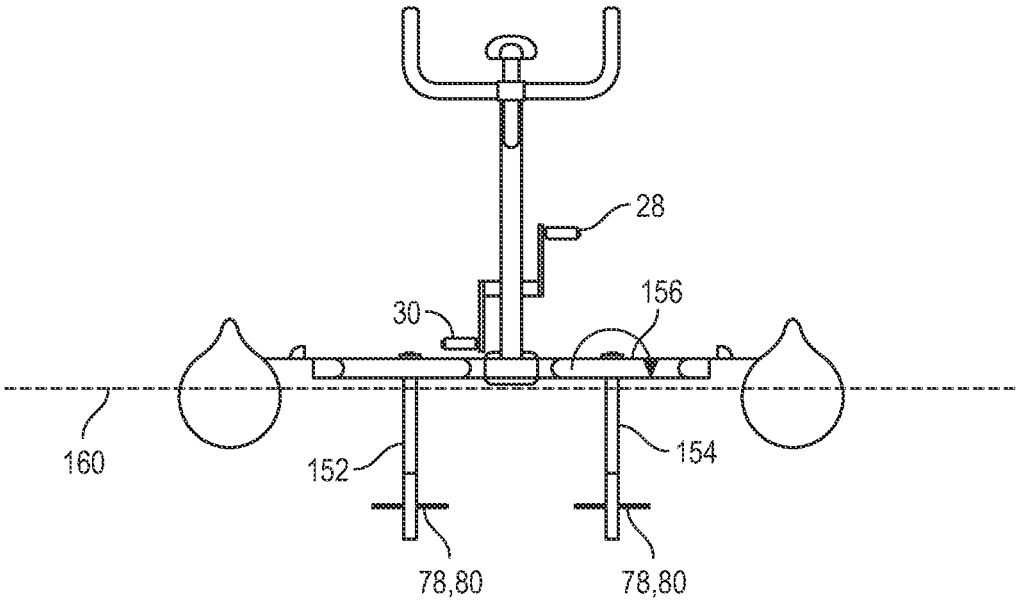
FIG. 17A is a rear view.
Figure 17B:
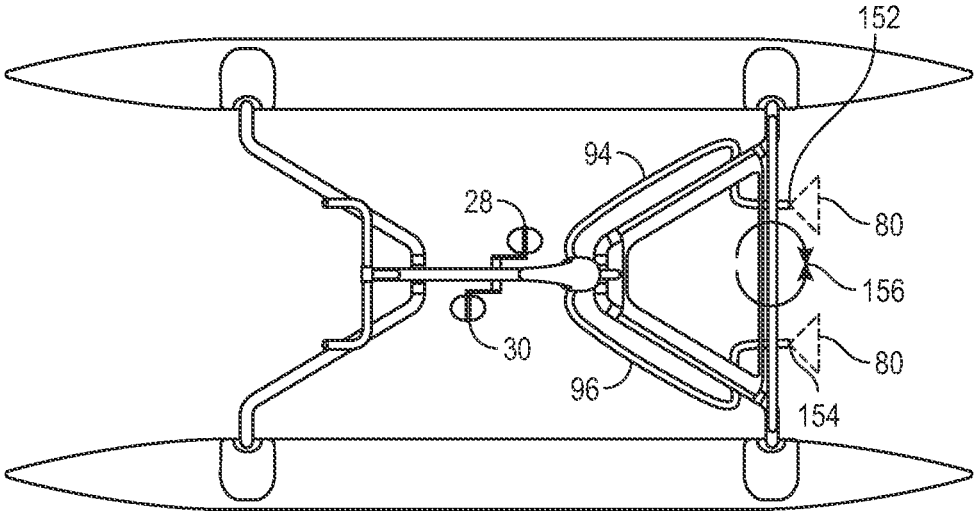
FIG. 17B is a top view, of the waterbike shown in FIG. 2.

When the pedals 28 and 30 are rotated, torque is transmitted through the entirety of the gear train, which turns the spiral shafts 94 and 96, thereby exerting forces on the reaction arms 152 and 154, that force the reaction arm control rod 156 to rotate to a ninety degree orientation, such that the spiral shafts 94 and 96, turn the propellers 78 and 80, which are positioned at right angles to the watercraft 20, and are submerged below the horizontal surface of the waterline, as shown in FIG. 17.

Figure 18:
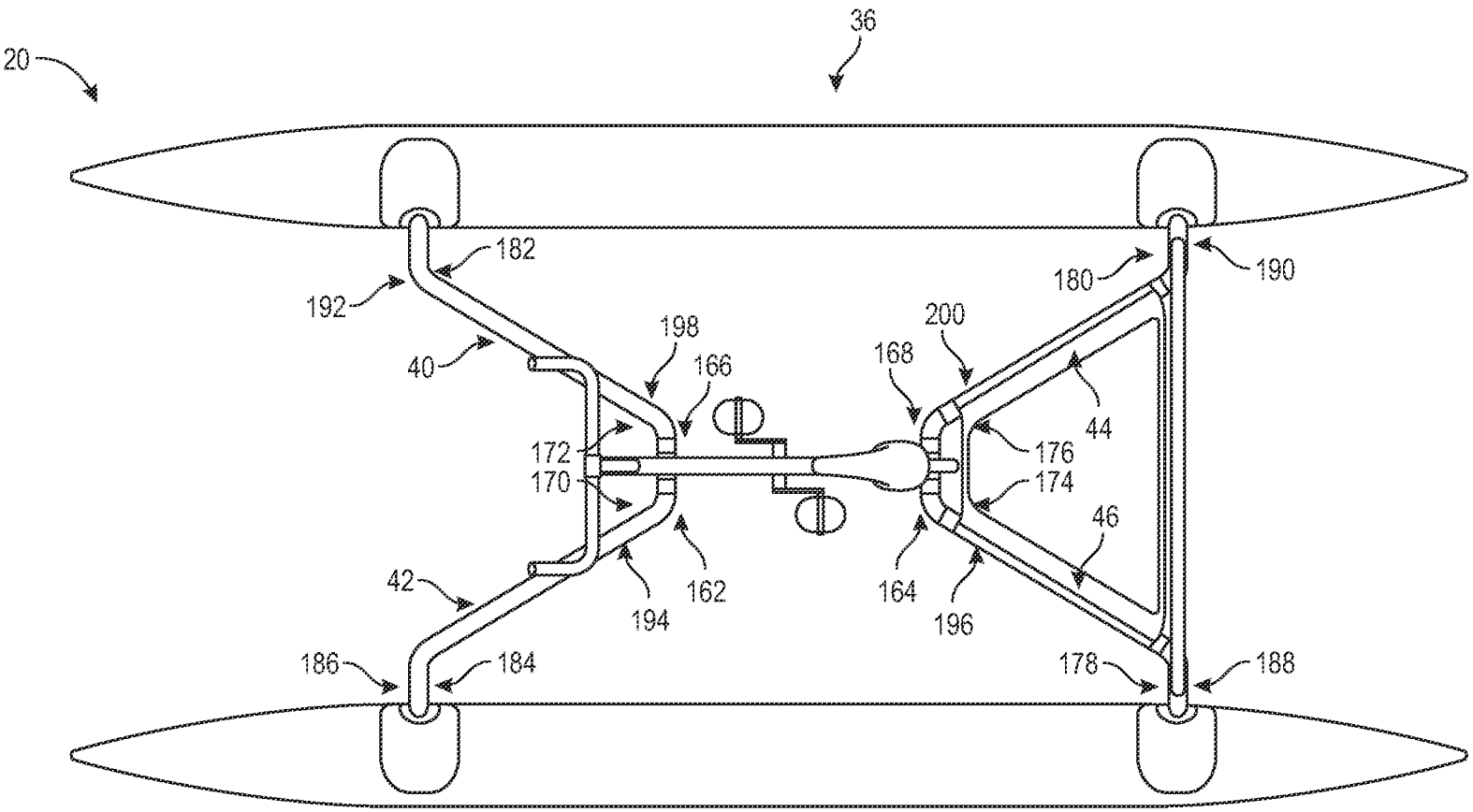
FIGS. 18 and 19 are top views of waterbikes.
Figure 19:
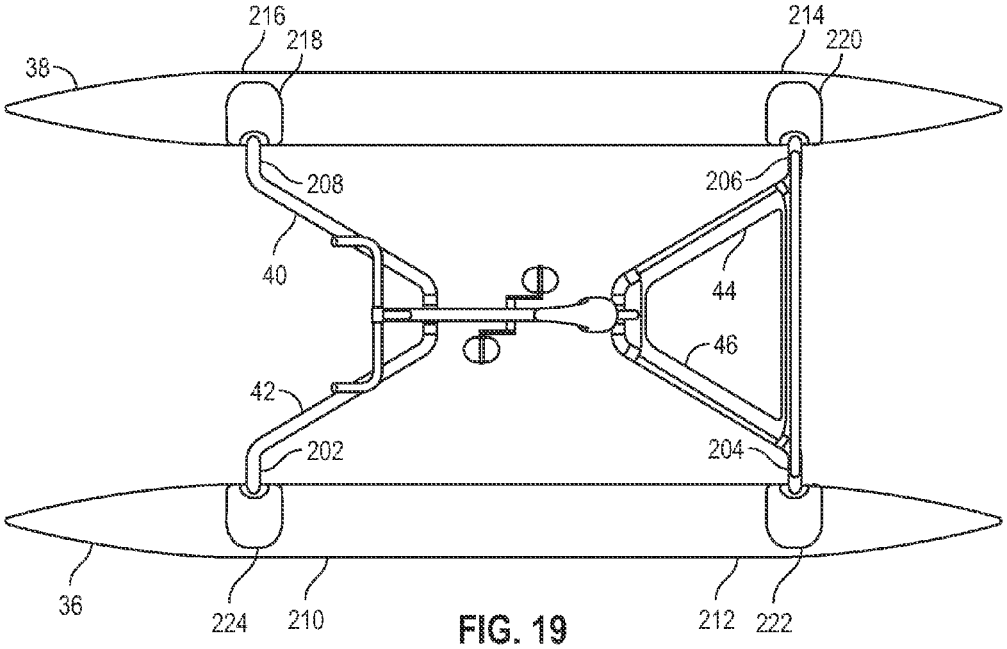

The four connecting struts 40, 42, 44 and 46, are coupled to four fittings 162, 164, 166 and 168, that are coupled to the frame 20, such that the connecting struts can be easily coupled and decoupled from the frame, and the pontoons 36 and 38 for compact storage and transit. At the terminus of each of the four connecting struts 40, 42, 44 and 46, are eight couplings 170, 172, 174, 176, 178, 180, 182 and 184, and each of the eight couplings are equipped with eight quick disconnect safety pins 186, 188, 190, 192, 194, 196, 198 and 200, that prevent the four connecting struts 40, 42, 44 and 46 from becoming dislodged from the frame 20, or the pontoons 36 and 38, as shown in FIG. 18.

Where the four connecting struts 40, 42, 44 and 46, intersect with the four pontoon fittings 202, 204, 206, 208, at each pontoon corner 210, 212, 214 and 216, incorporate a structural shape 218, 220, 222 and 224, that envelopes one hundred and eighty degrees of each pontoon 36 and 38, to counter the predominate physical tendency for the pontoons to roll out from under the pontoon fittings 202, 204, 206 and 208 when the frame 20, is loaded by a rider 226, to ensure the pontoons remain fixed at all times to the four connecting struts 40, 42, 44 and 46, and ultimately the frame of the watercraft 20, in all varieties of sea conditions, as shown in FIG. 19.

Two or more watercraft 228 and 230 may be attached to each other, while underway, or in a stationary modality prior to getting underway. Forming physically connected groups of watercraft can serve to achieve a collective performance advantage much like a tandem land-based bicycle, when a group experience is desired. Multiple watercraft when physically coupled can serve as an impromptu swimming platform, or in the event a rider may become fatigued, provide an added measure of safety by physically coupling a multiplicity of watercraft together.

Figure 20:
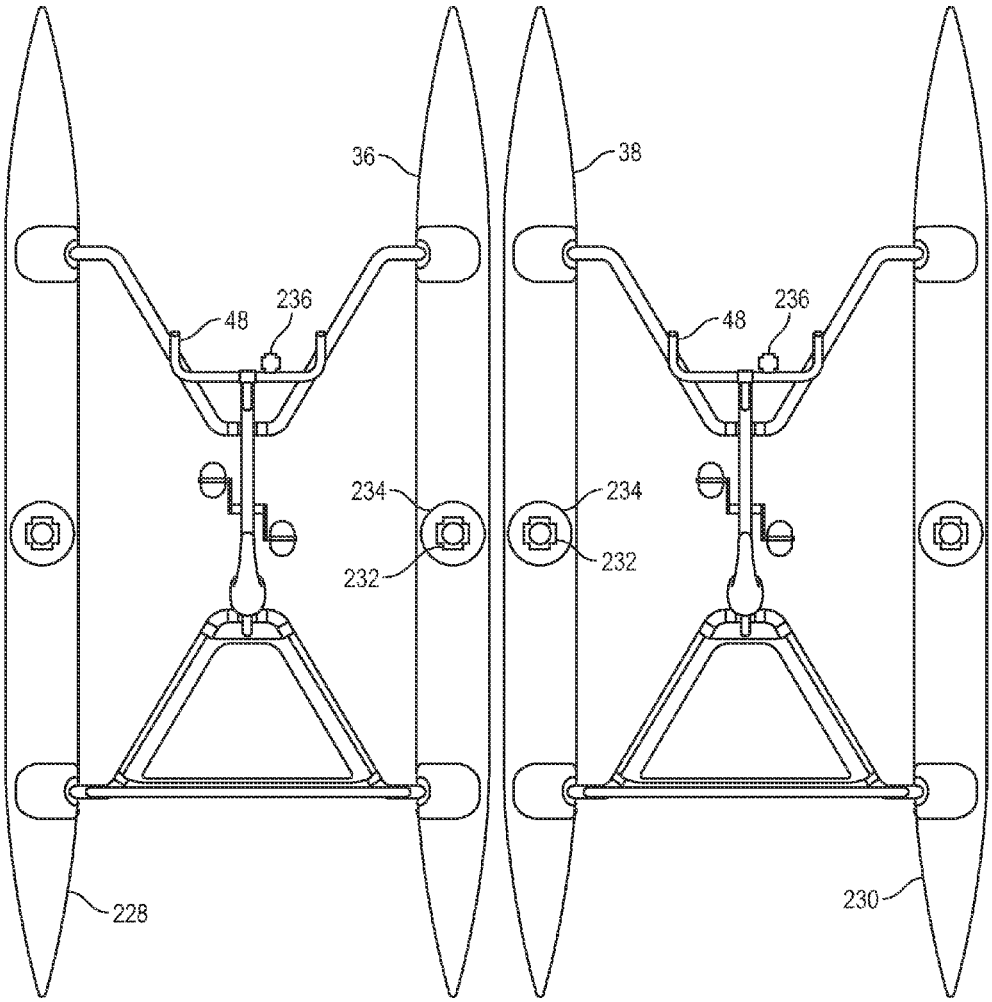
FIG. 20 is a top view of side-by-side waterbikes.

Whether the linkages are formed on water or land, and whether or not the watercraft are in motion or stationary, the proposed linking methods do not upset the stability of the watercraft and do not require watercraft operators to remove their hands from the handlebars, manipulate tools, or handle other extraneous apparatuses that may affect watercraft control, stability, or safety. In a first example, an electromagnetic switching device 232 is embedded in an adhesive patch 234 and that is adhered at the middle of each pontoon 36 and 38. The adhesive patch 234 and that is affixed at the middle of each pontoon, corresponds to the polar opposites of any similarly equipped watercraft, such that any similarly equipped watercraft when it becomes parallel to any other similarly equipped and positioned watercraft, can be magnetically coupled to the other, when an electrical switch 236, located on the handlebars 48, is activated. When decoupling is desired, the handlebar-mounted electrical switch 236 is deactivated, thereby shutting off any electromagnetic force and separation occurs. The side-by-side electromagnet coupling provides a means by which at least two waterbikes can be coupled, or conversely, as many as may be desired baring any spatial constraints, as shown in FIG. 20.

Figure 21:
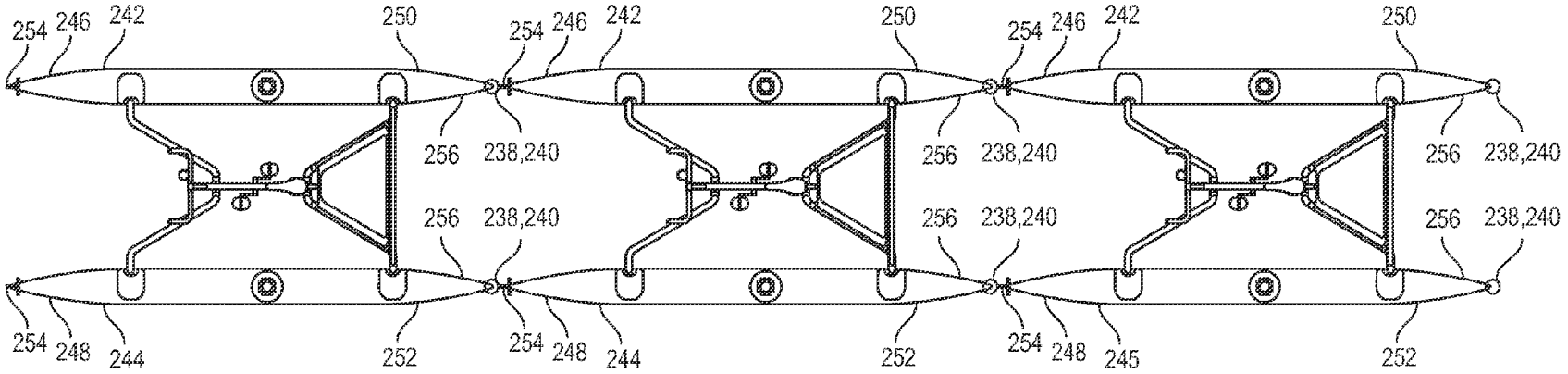
FIG. 21 is a top view of linked waterbikes.

In another embodiment, a mechanical coupling apparatus is employed. This design incorporates a pair of knuckle couplings 238 and 240, located at the rearward most point of each pontoon 242 and 244, with a second pair of knuckle couplings 246 and 248 located at the most forward point of each pontoon 250 and 252, and that vary in orientation and design mechanically link such that individual watercraft can mechanically couple end to end and such that all similarly equipped watercraft can form physical linkages between two or more watercraft. The rear-mounted knuckle couplings 238 and 240, while similar in appearance to the front-mounted knuckle couplings 246 and 248, have base plates that are oriented at opposing 90-degree axes, such that the circular ring 254 of the rear-mounted knuckle coupling 238 and 240, are oriented at a vertical plane relative to the circular ring 256 of the front-mounted knuckle coupling 246 and 248 which are oriented at a horizontal plane, as shown in FIG. 21.

Figure 22:
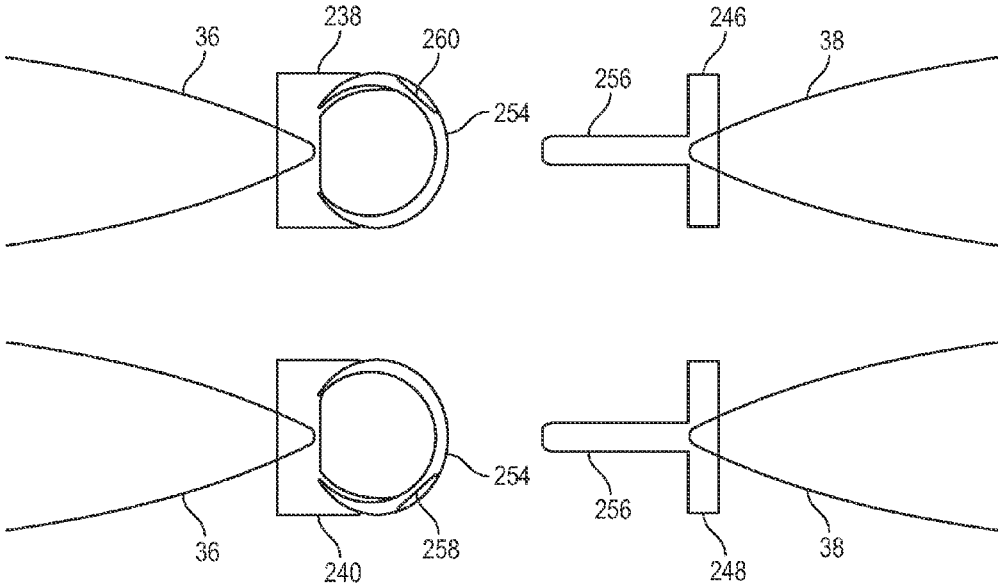
FIG. 22 is a partial section of a device coupled to a waterbike.

The rear-mounted knuckle couplings 238 and 240 and the front-mounted knuckle coupling 246 and 248, incorporate circular rings oriented on a vertical axis 254 and 256 when affixed to the front and rear points of each pontoon 36 and 38, and incorporate spring-loaded gates 258 and 260, as shown in FIG. 22.

When the rear-mounted knuckle couplings 238 and 240, that are oriented on a vertical axis come in contact with front-mounted knuckle couplings 246 and 248, that are oriented on the horizontal axis, contact between the two opposing knuckle couplings trigger the opening of the spring loaded gates 258 and 260, which are incorporated within the rear-mounted knuckle couplings 238 and 240, such that the spring-loaded gates 258 and 260 of the rear-mounted knuckle couplings retract, and allow the circular rings 256 of the front-mounted knuckle couplings to overlap with the circular rings 254 of rear-mounted knuckle couplings.

Figure 23A:
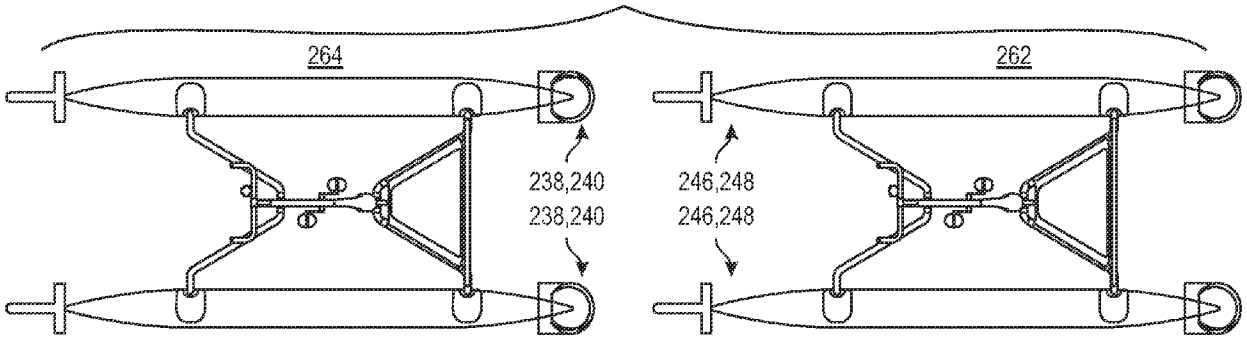
FIGS. 23A and 23B are top views of a device coupled to a waterbike.
Figure 23B:
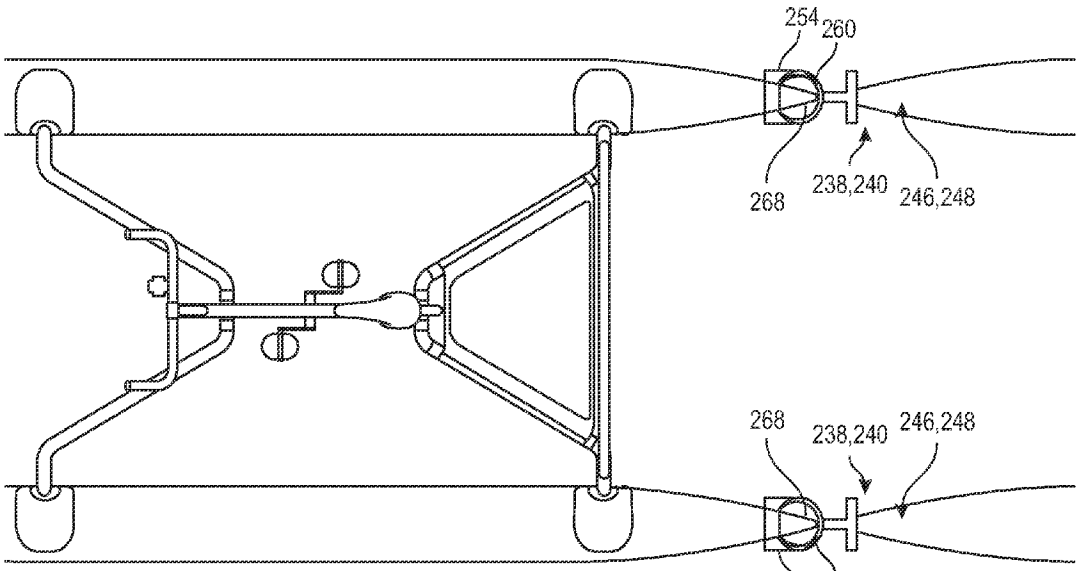

When the trailing watercraft 262 accelerates, and the leading watercraft 264 decelerates, such that contact is made between the rear-mounted knuckle couplings 238 and 240 and front-mounted knuckle couplings 246 and 248, the spring-loaded gates 258 and 260 within the circular rings 254 and 256 of the front-mounted knuckle couplings 238 and 240 to retract, thereby creating a semi-circular opening 266, which allows the front-mounted knuckle couplings of the rear watercraft 262, to overlap with the circular rings of rear-mounted knuckling couplings of the front watercraft 264, such that when the front-mounted knuckle coupling of the trailing watercraft makes physical contact with the base plate 268 of the rear-mounted knuckle couplings 238 and 240 of the leading watercraft, the base plate triggers the spring-loaded gates 258 and 260 of the rear-mounted knuckle couplings 238 and 240 which spring shut, thereby mechanically conjoining watercraft end-to-end, as shown in FIG. 23.

Figure 24:
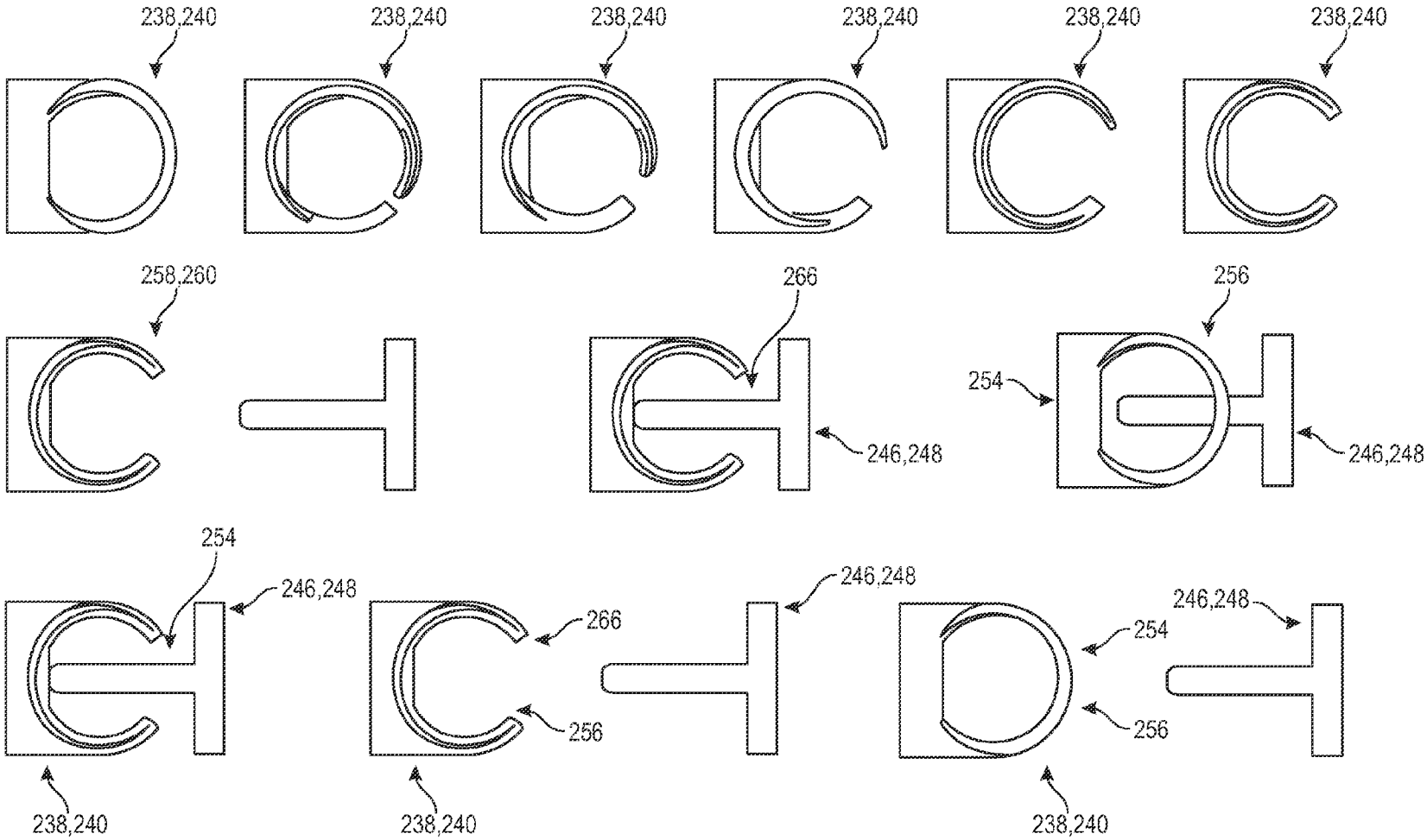
FIG. 24 is a diagram of side and top views of a device coupled to a waterbike.

The circular rings 254 and 256 of the front-mounted and rear-mounted knuckle couplings 238, 240, 246 and 248, provide the coupled watercraft with sufficient tolerances that undulating water surfaces that position coupled watercraft to one another at a variety of unpredictable angles can be so positioned without binding or doing damage to any watercraft so coupled. For watercraft to uncouple from one another, the spring-loaded gates 258 and 260 incorporated within the rear-facing knuckle couplings 246 and 248, are opened when the leading 264 and trailing watercraft 262 repeat the acceleration and deceleration sequences, such that when the trailing watercraft's front-mounted knuckle couplings 246 and 248, makes contact with the leading watercraft's rear-mounted knuckle couplings 238 and 240, the spring loaded gates 258 and 260 are released and the circular rings 254 and 256 spring open, thereby allowing the trailing watercraft 262, to detach from the leading watercraft 264, as shown in FIG. 24.

Figure 25:
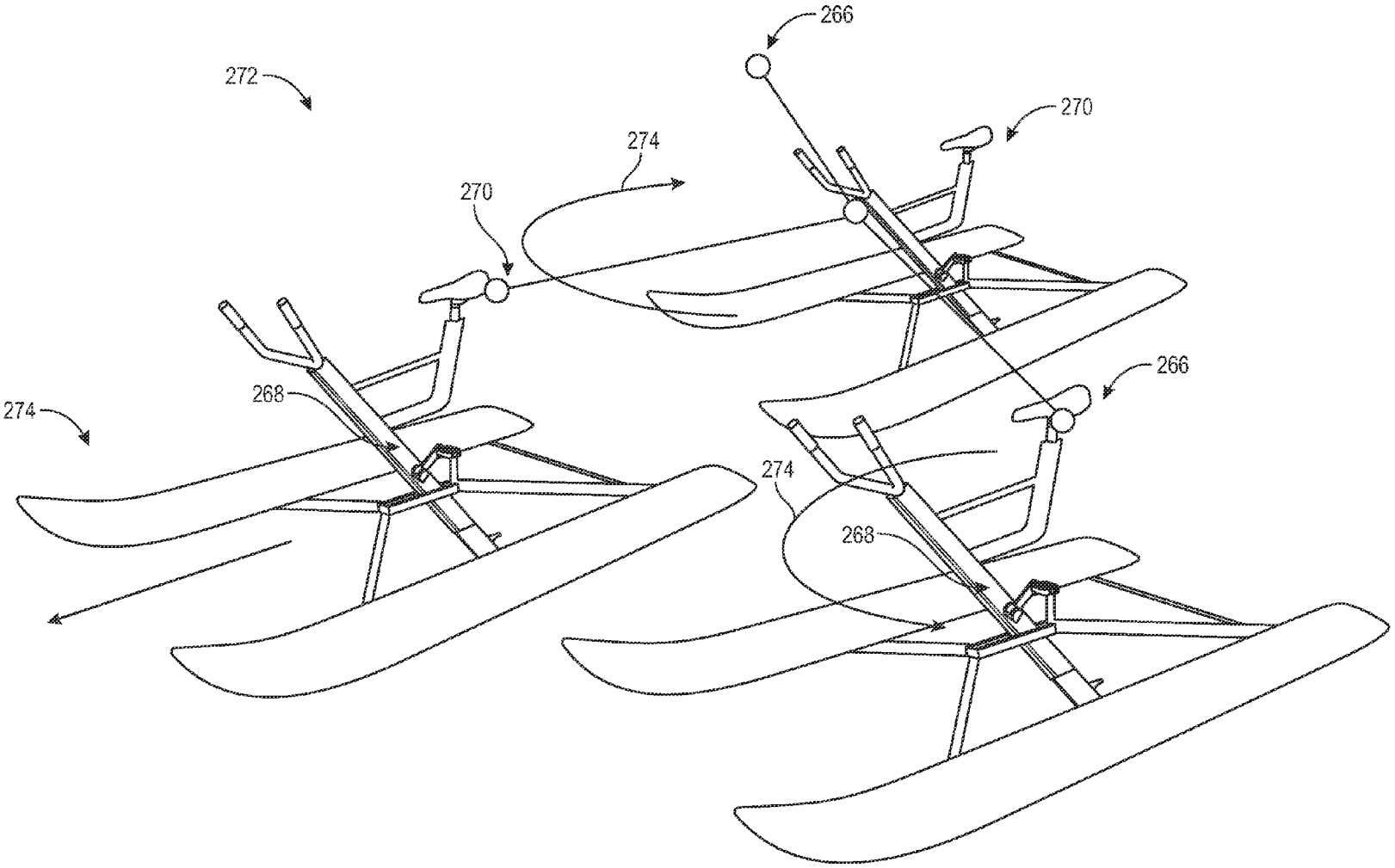
FIG. 25 is a perspective view of an alternative design.
Figure 26A:
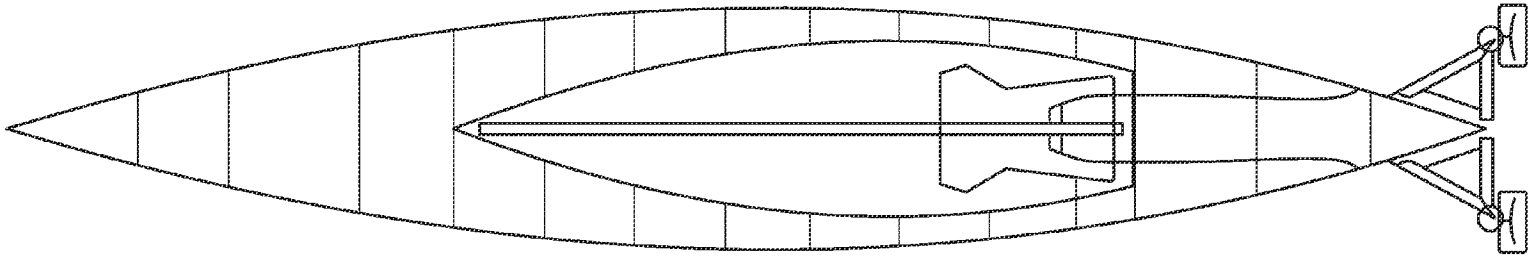
FIGS. 26A and 26B are a side and top view of a kayak.
Figure 26B:
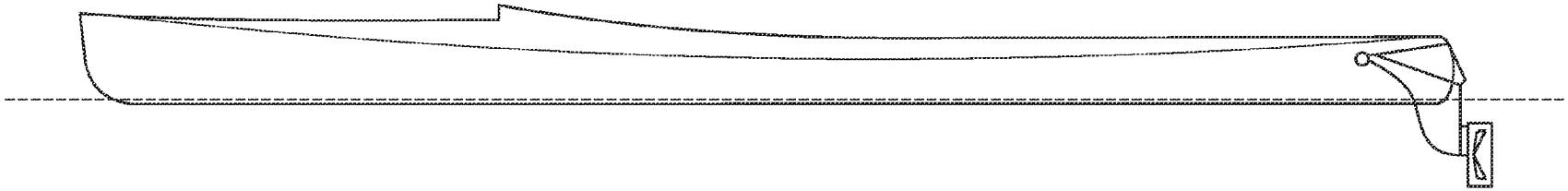
Figure 27A:
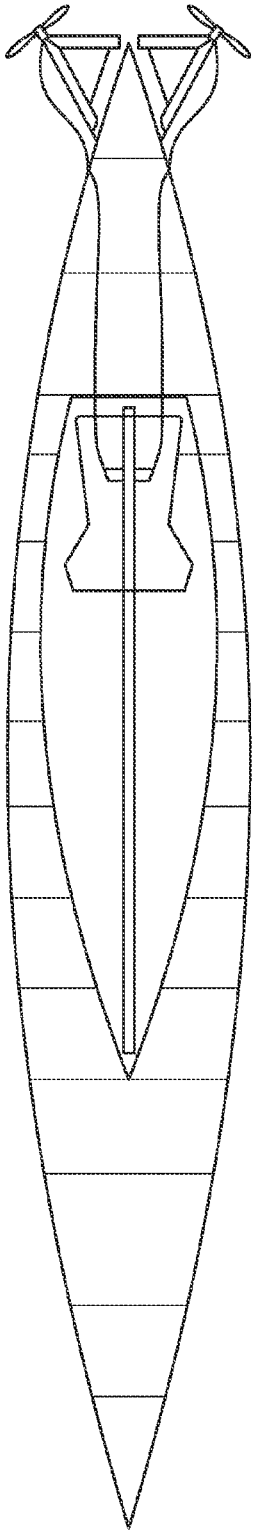
FIGS. 27A and 27B are a side and top view of the kayak in FIGS. 26A and 26B.
Figure 27B:
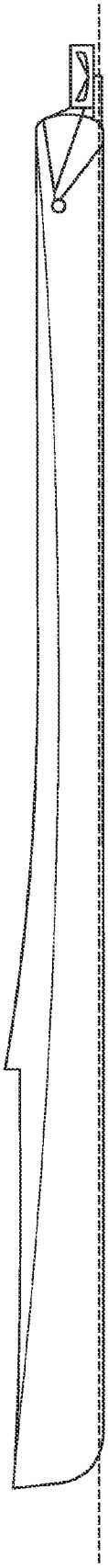
Figure 28A:
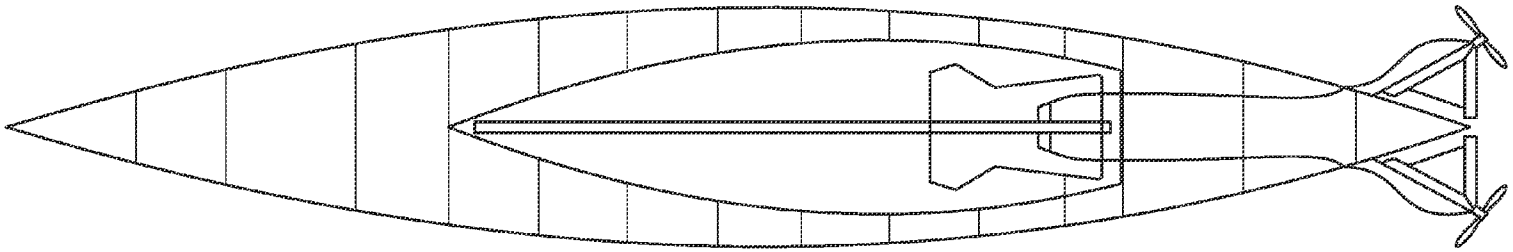
FIGS. 28A and 28B are a side view and a top view of the kayak in FIGS. 26A and 26B showing additional elements of operation.
Figure 28B:
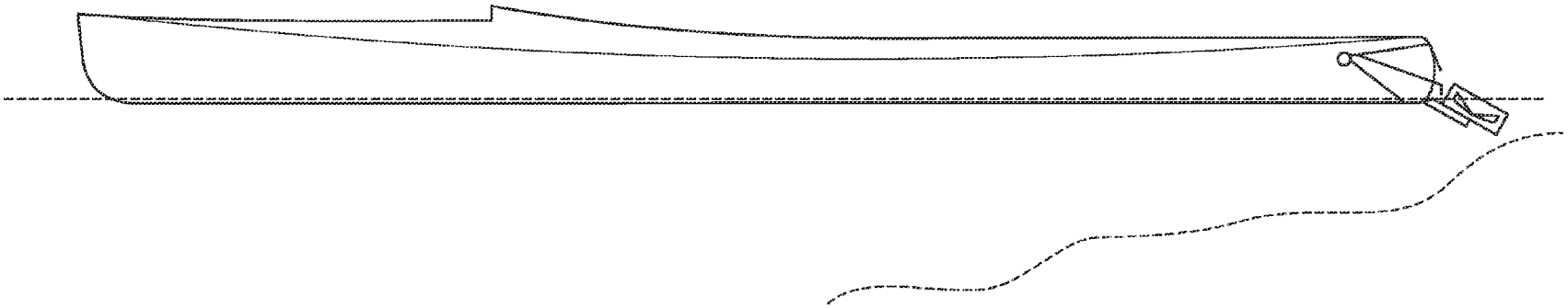
Figure 29A:
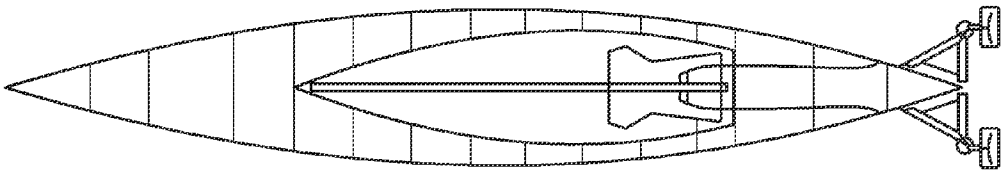
FIGS. 29A, 29B and 29C are a sequence of top views of the kayak in FIGS. 26A and 26B.
Figure 29B:
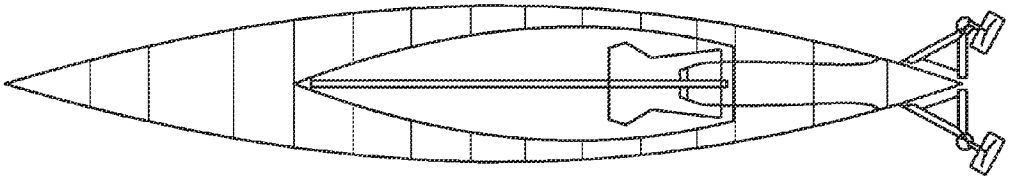
Figure 29C:
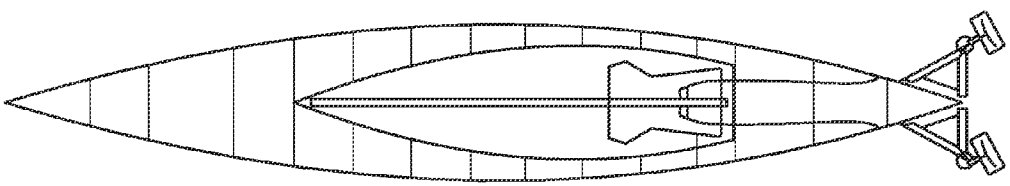
Figure 30:
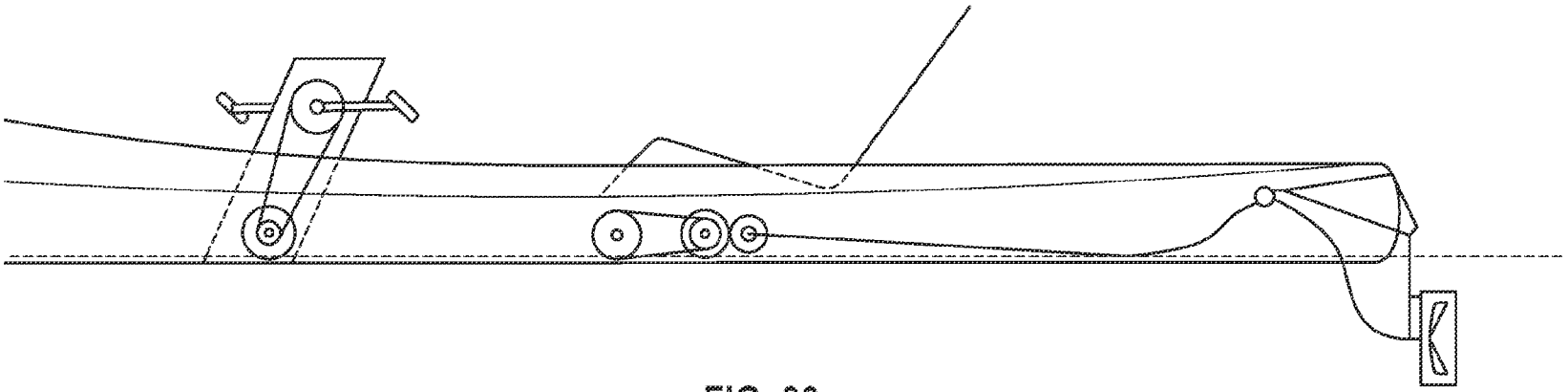
FIG. 30 is a section view of the kayak in FIG. 26A.

A torsion strut 266 may be provided that can swing about an arc of 220 degrees. The torsion strut 266 is adapted to be coupled at the front-most area of the watercraft frame 268, and to a similar coupling at the rear seat-post area of the opposing watercraft frame 270, such that when watercraft similarly equipped come within a prescribed distance, they can be physically conjoined 272, and in a multiplicity of arrangements 274 about a 220 degree arc of rotation, as shown in FIG. 25.

One preferred embodiment is a pedaled waterbike propelled by a pair of propellers. The propellers are coupled to a pair of spiral shafts coupled to the watercraft by a pair of pivoting mechanisms that are operably coupled to a pair of reaction arms. As the speed of the pedals are increased or decreased, the reaction arms pivot. The pivoting action forces the propellers to swing in a ninety-degree arc such that when the propellers are not providing thrust, they automatically withdraw from the water to minimize viscous drag. Conversely, when the operator begins pedaling, the propellers are drawn into the water where they become positioned at right angles to the surface of the water and the waterbike, such that the angle of attack of each propeller is optimized for maximum thrust.

As the cranks or pedals are rotated, the propellers also rotate and varying RPM depending on the operator's preference with regards to desired speed or amount of preferred exertion. As more torque is placed on the cranks, the spiral shafts are forced by the reaction arms to move in a direction that changes the angle of the propellers from a vertical axis to a horizontal axis relative to the waterbike frame and the surface plane of the water which allows the waterbike to operate in shallower depths than current methods. There are spiral shafts coupled to an output shaft that is adapted to be coupled to a bicycle transmission, or an electric motor, which are coupled to a pair of spur gears that alter the speed of the spiral shafts and the speed of the propellers based on the rotation speed of the pedals.

As self-propelled watercraft are predominantly of a fixed gear ratio, and as multiple gear ratios or motor assist are desirable for augmenting propeller speeds, and overcoming the limitation of muscle power, a multiplicity of gear ratios and the provision for a motor increase the utility of waterborne vehicle. Due to the highly corrosive nature of seawater and salt air, the propulsion method is isolated within the interior of a watertight structure. To still achieve a desired spectrum of gear ratios that can accommodate riders of varying fitness levels, and be of sufficient compactness to be isolated within the watertight structure or frame, the propulsion method may provide at least two stages of gear-reduction. To further minimize maintenance and lubrication requirements, toothed belts constructed of composite materials, or plastic chain may be used in place of steel chains and or, nylon gears in place of metal gears.

A jackshaft may be provided at the intersection between the vertical and horizontal watertight frame sections to allow space for a pulley or sprocket that is at least twice the diameter of the preceding pulley or sprocket which allows for a compact external frame while still providing a large gear reduction.

Pulleys or sprockets, one larger and the other smaller, are attached to the jackshaft. A belt or plastic chain on the smaller sprocket is coupled on a vertical axis to the input shaft located above in the vertically oriented watertight compartment. From the large pulley, a second belt or plastic chain is coupled on a horizontal axis to a third pulley that is coupled to a tertiary shaft, a bicycle transmission, or an electric motor. The belt or plastic chain that is oriented on a vertical axis and is coupled between the jackshaft and the input shaft and where the crank arms are coupled, is described as the primary stage of reduction, and offers a minimum a 3:1 gear ratio. The belt or plastic chain that is coupled between the jackshaft and the tertiary shaft, or in place of this shaft, a bicycle transmission or a motor, is described as the secondary stage of reduction, and which offers an additional 3:1 ratio minimum.

A third stage of reduction may comprise a pair of spur gears. A first spur gear is coupled to the tertiary shaft, bicycle transmission, or motor, and a second spur gear, which is coupled to the output shaft. The reduction ratio of the spur gears offer at minimum an additional 3:1 ratio, and not including the mechanical advantage of the bicycle transmission, or the electromechanical advantage of the motor, the propulsion system as herein described facilitates a minimum drive train ratio of 9:1 but can exceed 20:1. This ratio is suitable for muscle power output and optimizes propeller RPM such that an optimal amount of thrust may be achieved using minimal amounts of muscle power. The system may use a 55T drive pulley coupled to a 22T pulley attached to a shaft that turns a spiral bevel gear set with a 1:3 step up, providing a two stage step up 1:2.5 and 1:3 for a total step up of 1:7.5

To augment human performance such that the propellers can be turned faster than a fixed ratio of 9:1, a bicycle transmission can be used with gear ratios that elevate the fixed 9:1 ratio to a ratio to 20:1 or higher. The mechanical advantage of three stages of gear reduction, e.g., the primary, secondary and tertiary (or spur gears) coupled to a bicycle transmission, or electric motor, solves the problem of how to provide the widest possible range of gear range while packaging the propulsion system within the interior of a watertight frame.

Viscous drag disproportionally affects the net energy potential of a human-powered watercraft as compared to motorized watercraft. To reduce viscous drag, the reaction arms may be coupled via pivoting mechanisms to the frame. This allows the reaction arms to pivot when the operator ceases pedaling, so that a propeller or propellers automatically withdraw from the water to minimize drag, or to avoid propeller damage in the event the watercraft runs aground, or is operated in shallow water.

Additionally a steering linkage can be provided that leads to a pair of levers adapted to be coupled to handlebars. In the preferred embodiment, when the right or left lever is manipulated, the propellers oscillate in an arc, or a rudder pivots, which in either case provide directional control. This increases stability of the watercraft as the rider can remain tucked when affecting directional control. A steerable propeller may be used in place of a rudder to further reduce drag. The propulsion system may use only rotary oriented gears, pulleys, and or shafts, for improved efficiency.

A cable is attached at these vertical control arms and additionally to a bell-crank. The bell crank is coupled to a pair of cables or rods controlled by handlebars or levers, such that when the operator steers or applies pressure to the individual levers, a propeller or propellers oscillate, or a rudder pivots, that at the discretion of the rider directs the watercraft along a desired course. Furthermore, the propeller or propellers are coupled to one or more spiral shafts and that are individually coupled to an output shaft and ultimately a crank set that when turned by hands or feet, propel the watercraft. When the crankshaft is rotated, one or more spiral shafts that are coupled to one or more propellers also turn. The spiral shaft or shafts by being coupled to a reaction arm, or arms, are prevented from wandering when under load which makes the watercraft more efficient.

To further optimize the performance of the watercraft, a reaction arm or arms are affixed to the vessel at a strategically advantageous point and have a pivot mechanism. The positioning of the reaction arm and its coupling to the spiral shaft which has a fixed distance between the output shaft and the propeller or propellers, forms a parallelogram. So configured, when the watercraft is pedaled, or cranked, the torque affects a forces on the spiral shaft or shafts that force the reaction arm or arms to pivot. The reaction arm or arms continue to pivot until stops are contacted that orient the propeller or propellers at ninety degree angle to the water surface. As the operator reaches progressively deeper water and the operator elects to add torque at the crankshaft, twist at the spiral shaft increases. This twist is constrained by the reaction arm that by virtue of a mounting to the vessel at a pivot point draws the reaction arm progressively downward until the reaction arm reaches a predetermined stopping point.

This stopping point positions the propeller at a right angle to the vessel and the water, and which in turn maximizes the efficiency of the propeller. This configuration also allows the vessel to be propelled and turned at uncommonly shallow depths. Conversely when the vessel encounters the sea bottom, the reaction arm pivots upwards so that the propeller or propellers are not damaged and continues to permit propulsion and steerage although not at peak hydrodynamic efficiency. In the preferred embodiment two spiral shafts are incorporated, as are two propellers and two reaction arms. The twin prop configuration reduces the dimensional circumference of a single propeller to improve maneuverability and provide for a shallower draft.

Thus, novel designs have been shown and described. Various changes and substitutions may of course be made without departing from the spirit and scope of the invention. The invention, therefore, should not be limited, except by the following claims and their equivalents.

What is claimed is:

1. A watercraft comprising:

at least one hull;

a propeller on a vane operably coupled to a pivoting mechanism supported by the hull, with the propeller driven via pedals on bicycle type crank arms driving a gear, pulley or sprocket and one or more belts or chains;

a handle bar supported on the hull, with the handle bar connected to a steering system for steering the vane via cables by pivoting the vane about a first axis, and with the watercraft having no rudder; and with the pivoting mechanism allowing the vane to pivot in an arc about a second axis perpendicular to the first axis.

2. The watercraft of claim 1 wherein with hull floating on water, the vane is pivotable on the pivoting mechanism to a full down position wherein the propeller rotates in a plane perpendicular to the surface of the water.

3. The watercraft of claim 1 wherein the propulsion system includes a pair of spiral shafts coupled to an output shaft that is adapted to be coupled to a bicycle transmission, or an electric motor, which are coupled to a pair of spur gears that alter the speed of the spiral shafts and the speed of the propellers based on the rotation speed of the pedals.

4. The watercraft of claim 1 wherein the vane is steerable through an arc of +/−80 degrees.

5. The watercraft of claim 1 with the hull comprising a pair of pontoons attached via diagonal struts.

6. The watercraft of claim 1 further comprising a frame attached to the hull and wherein the cables are internal to the frame.

7. The watercraft of claim 1 further including a limiting stop that stops the vane at a position where a rotation axis of the propeller is parallel to a longitudinal axis of the hull.

8. The watercraft in claim 5 wherein an end of each diagonal strut is attached to one of the pontoons with a pin which allows that diagonal strut to be detached from that pontoon without using a hand tool.

9. The watercraft of claim 1 with the vane having a first end attached to the pivoting mechanism and with the propeller attached at a second end of the vane, and with the vane curving through a right angle so that the second end of the vane is perpendicular to the first end of the vane.

10. A watercraft comprising:

first and second spaced apart pontoons;

first and second struts attached to the first and second pontoons;

a frame attached to the first and second struts;

first and second pedals rotatably attached to first and second crank arms, respectively, with the first and second crank arms connected to a first sprocket, gear or pulley rotatably mounted on the frame;

a belt or chain around the first sprocket, gear or pulley and around a second sprocket, gear or pulley attached to a jack shaft;

a pivoting mechanism on the frame;

a vane having a first end attached to the pivoting mechanism;

a propeller attached to a second end of the vane, with the vane curving through a right angle, and with the vane pivotable about first axis for steering the watercraft, with the watercraft having no rudder, and with the pivoting mechanism allowing the vane to pivot about a second axis perpendicular to the first axis;

with the jack shaft driven by rotation of the first sprocket, gear or pulley, and with the jack shaft in turn driving gears which rotate the propeller;

a seat on the frame;

a handle bar attached to a steering shaft rotatably supported in the frame; and at least one steering cable engaged onto the steering shaft and extending to the pivoting mechanism for steering the vane.

* * * * *